US007983784B2

(12) United States Patent
Yamada

(10) Patent No.: US 7,983,784 B2
(45) Date of Patent: Jul. 19, 2011

(54) DATA STRUCTURE OF BRANCH-STRUCTURED VECTOR DATA, BRANCH-STRUCTURED VECTOR DATA EDITING APPARATUS, AND EMBROIDERY DATA CREATION APPARATUS

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1152 days.

(21) Appl. No.: 11/727,150

(22) Filed: Mar. 23, 2007

(65) Prior Publication Data

US 2007/0225855 A1 Sep. 27, 2007

(30) Foreign Application Priority Data

Mar. 27, 2006 (JP) ..... 2006-084955

(51) Int. Cl.
*D05C 5/02* (2006.01)

(52) U.S. Cl. ..... 700/138

(58) Field of Classification Search ..... 700/136–138; 112/475.18–475.19, 102.5, 470.01, 470.06
See application file for complete search history.

(56) References Cited

U.S. PATENT DOCUMENTS 5,560,306 A * 10/1996 Kyuno et al. ..... 112/475.19
5,701,830 A * 12/1997 Muto ..... 112/102.5
5,765,496 A * 6/1998 Futamura ..... 112/475.19
6,012,402 A * 1/2000 Sekine ..... 112/470.04
6,324,441 B1 * 11/2001 Yamada ..... 700/138
6,356,648 B1 * 3/2002 Taguchi ..... 700/138
6,502,006 B1 * 12/2002 Laufer et al. ..... 700/138
6,952,626 B1 * 10/2005 Taguchi et al. ..... 700/138
2002/0038162 A1 * 3/2002 Yamada ..... 700/138

FOREIGN PATENT DOCUMENTS

JP A-08-038756 2/1996
JP A-2005-203391 7/2005

* cited by examiner

*Primary Examiner* — Gary L. Welch
*Assistant Examiner* — Nathan E Durham
(74) *Attorney, Agent, or Firm* — Oliff & Berridge PLC

(57) ABSTRACT

A data structure of branch-structured vector data that is created from line drawing information of an embroidery design and provides a basis for creating embroidery data by a computer that includes at least one data piece of a branch, which is an embroidery path connecting two endpoints. The branch data piece may include thread color information that indicates a color of a sewing thread to be used when each of the branches is embroidered, or loop information that indicates whether tracing a link destination of the endpoint of the branch results in generation of a loop that returns to the same endpoint. The thread color information may be used to determine whether to create embroidery data for a link destination branch and the loop information may be used to determine whether to create running stitch sewing data for the link destination branch. Thus, branch-structured vector data may have information of a plurality of thread colors and represent a loop in one data piece.

8 Claims, 26 Drawing Sheets

310

FIG. 7

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFOR-MATION | THREAD COLOR INFOR-MATION |
| | LINK DESTINATION BRANCH IDENTIFI-CATION INFORMATION | LINK DESTINATION BRANCH ENDPOINT INFORMATION | LOOP INFOR-MATION | LINK DESTINATION BRANCH IDENTIFI-CATION INFORMATION | LINK DESTINATION BRANCH ENDPOINT INFORMATION | LOOP INFOR-MATION | | | |
| E1 | NOT PROVIDED | NOT PROVIDED | NOT PROVIDED | E2 | INITIAL POINT | NOT PROVIDED | | ZIGZAG | GREEN |
| E2 | E3 | TERMINAL POINT | NOT PROVIDED | NOT PROVIDED | NOT PROVIDED | NOT PROVIDED | | ZIGZAG | GREEN |
| E3 | NOT PROVIDED | NOT PROVIDED | NOT PROVIDED | NOT PROVIDED | NOT PROVIDED | NOT PROVIDED | | ZIGZAG | GREEN |

FIG. 8

413

EMBROIDERY DATA

| | | |
|---|---|---|
| RUNNING STITCH SEWING DATA | INITIAL POINT N0 TO TERMINAL POINT N1 OF BRANCH E1 | 4131 |
| RUNNING STITCH SEWING DATA | INITIAL POINT N1 TO TERMINAL POINT N2 OF BRANCH E2 | 4132 |
| STITCH SEWING DATA | TERMINAL POINT N2 TO INITIAL POINT N1 OF BRANCH E2 | 4133 |
| RUNNING STITCH SEWING DATA | TERMINAL POINT N1 TO INITIAL POINT N3 OF BRANCH E3 | 4134 |
| STITCH SEWING DATA | INITIAL POINT N3 TO TERMINAL POINT N1 OF BRANCH E3 | 4135 |
| STITCH SEWING DATA | TERMINAL POINT N1 TO INITIAL POINT N0 OF BRANCH E1 | 4136 |

320

FIG. 10

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFORMATION | THREAD COLOR INFORMATION |
| | LINK DESTINATION BRANCH IDENTIFICATION INFORMATION | LINK DESTINATION BRANCH ENDPOINT INFORMATION | LOOP INFORMATION | LINK DESTINATION BRANCH IDENTIFICATION INFORMATION | LINK DESTINATION BRANCH ENDPOINT INFORMATION | LOOP INFORMATION | | | |
| E1 | NOT PROVIDED | NOT PROVIDED | NOT PROVIDED | E2 | INITIAL POINT | NOT PROVIDED | | ZIGZAG | GREEN |
| E2 | E3 | TERMINAL POINT | NOT PROVIDED | NOT PROVIDED | NOT PROVIDED | NOT PROVIDED | | ZIGZAG | RED |
| E3 | NOT PROVIDED | NOT PROVIDED | NOT PROVIDED | NOT PROVIDED | NOT PROVIDED | NOT PROVIDED | | ZIGZAG | GREEN |

FIG. 11

423

| EMBROIDERY DATA | | |
|---|---|---|
| RUNNING STITCH SEWING DATA | INITIAL POINT N0 TO TERMINAL POINT N1 OF BRANCH E1 | 4231 |
| RUNNING STITCH SEWING DATA | TERMINAL POINT N1 TO INITIAL POINT N3 OF BRANCH E3 | 4232 |
| STITCH SEWING DATA | INITIAL POINT N3 TO TERMINAL POINT N1 OF BRANCH E3 | 4233 |
| STITCH SEWING DATA | TERMINAL POINT N1 TO INITIAL POINT N0 OF BRANCH E1 | 4234 |

FIG. 15

331

BRANCH-STRUCTURED VECTOR DATA

| BRANCH DATA NO. | INITIAL POINT LINK INFORMATION | | | TERMINAL POINT LINK INFORMATION | | | VECTOR DATA | SEWING METHOD INFORMATION | THREAD COLOR INFORMATION |
|---|---|---|---|---|---|---|---|---|---|
| | LINK DESTINATION BRANCH IDENTIFICATION INFORMATION | LINK DESTINATION BRANCH ENDPOINT INFORMATION | LOOP INFORMATION | LINK DESTINATION BRANCH IDENTIFICATION INFORMATION | LINK DESTINATION BRANCH ENDPOINT INFORMATION | LOOP INFORMATION | | | |
| E11 | NOT PROVIDED | NOT PROVIDED | NOT PROVIDED | E11 | INITIAL POINT | PROVIDED | | ZIGZAG | GREEN |

FIG. 16

332

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFOR-MATION | THREAD COLOR INFOR-MATION |
| | LINK DESTINATION BRANCH IDENTIFI-CATION INFORMATION | LINK DESTINATION BRANCH ENDPOINT INFORMATION | LOOP INFOR-MATION | LINK DESTINATION BRANCH IDENTIFI-CATION INFORMATION | LINK DESTINATION BRANCH ENDPOINT INFORMATION | LOOP INFOR-MATION | | | |
| E12 | NOT PROVIDED | NOT PROVIDED | NOT PROVIDED | NOT PROVIDED | NOT PROVIDED | NOT PROVIDED | | ZIGZAG | GREEN |

FIG. 18

340

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFORMATION | THREAD COLOR INFORMATION |
| | LINK DESTINATION BRANCH IDENTIFICATION INFORMATION | LINK DESTINATION BRANCH ENDPOINT INFORMATION | LOOP INFORMATION | LINK DESTINATION BRANCH IDENTIFICATION INFORMATION | LINK DESTINATION BRANCH ENDPOINT INFORMATION | LOOP INFORMATION | | | |
| E11 | NOT PROVIDED | NOT PROVIDED | NOT PROVIDED | E12 | TERMINAL POINT | NOT PROVIDED | | ZIGZAG | GREEN |
| E12 | NOT PROVIDED | NOT PROVIDED | NOT PROVIDED | E11 | INITIAL POINT | PROVIDED | | ZIGZAG | GREEN |

FIG. 19

443

| EMBROIDERY DATA | | |
|---|---|---|
| RUNNING STITCH SEWING DATA | INITIAL POINT N10 TO TERMINAL POINT N10 OF BRANCH E11 | 4431 |
| RUNNING STITCH SEWING DATA | TERMINAL POINT N10 TO INITIAL POINT N11 OF BRANCH E12 | 4432 |
| STITCH SEWING DATA | INITIAL POINT N11 TO TERMINAL POINT N10 OF BRANCH E12 | 4433 |
| STITCH SEWING DATA | TERMINAL POINT N10 TO INITIAL POINT N10 OF BRANCH E11 | 4434 |

FIG. 22

351

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFORMATION | THREAD COLOR INFORMATION |
| | LINK DESTINATION BRANCH IDENTIFICATION INFORMATION | LINK DESTINATION BRANCH ENDPOINT INFORMATION | LOOP INFORMATION | LINK DESTINATION BRANCH IDENTIFICATION INFORMATION | LINK DESTINATION BRANCH ENDPOINT INFORMATION | LOOP INFORMATION | | | |
| E11 | NOT PROVIDED | NOT PROVIDED | NOT PROVIDED | NOT PROVIDED | NOT PROVIDED | NOT PROVIDED | | ZIGZAG | GREEN |
| E12 | NOT PROVIDED | NOT PROVIDED | NOT PROVIDED | E11 | INITIAL POINT | PROVIDED | | ZIGZAG | GREEN |
| E13 | NOT PROVIDED | NOT PROVIDED | NOT PROVIDED | E12 | TERMINAL POINT | NOT PROVIDED | | ZIGZAG | GREEN |

FIG. 23

352

| BRANCH-STRUCTURED VECTOR DATA | | | | | | | | | |
|---|---|---|---|---|---|---|---|---|---|
| BRANCH DATA NO. | INITIAL POINT LINK INFORMATION | | | TERMINAL POINT LINK INFORMATION | | | VECTOR DATA | SEWING METHOD INFORMATION | THREAD COLOR INFORMATION |
| | LINK DESTINATION BRANCH IDENTIFICATION INFORMATION | LINK DESTINATION BRANCH ENDPOINT INFORMATION | LOOP INFORMATION | LINK DESTINATION BRANCH IDENTIFICATION INFORMATION | LINK DESTINATION BRANCH ENDPOINT INFORMATION | LOOP INFORMATION | | | |
| E11 | NOT PROVIDED | NOT PROVIDED | NOT PROVIDED | NOT PROVIDED | NOT PROVIDED | NOT PROVIDED | | ZIGZAG | GREEN |
| E12 | NOT PROVIDED | NOT PROVIDED | NOT PROVIDED | E11 | INITIAL POINT | NOT PROVIDED | | ZIGZAG | GREEN |
| E13 | NOT PROVIDED | NOT PROVIDED | NOT PROVIDED | E12 | TERMINAL POINT | NOT PROVIDED | | ZIGZAG | GREEN |

FIG. 24

453

| EMBROIDERY DATA | | |
|---|---|---|
| RUNNING STITCH SEWING DATA | INITIAL POINT N13 TO TERMINAL POINT N10 OF BRANCH E13 | 4531 |
| RUNNING STITCH SEWING DATA | TERMINAL POINT N10 TO INITIAL POINT N11 OF BRANCH E12 | 4532 |
| STITCH SEWING DATA | INITIAL POINT N11 TO TERMINAL POINT N10 OF BRANCH E12 | 4533 |
| RUNNING STITCH SEWING DATA | INITIAL POINT N10 TO TERMINAL POINT N13 OF BRANCH E11 | 4534 |
| STITCH SEWING DATA | TERMINAL POINT N13 TO INITIAL POINT N10 OF BRANCH E11 | 4535 |
| STITCH SEWING DATA | TERMINAL POINT N10 TO INITIAL POINT N13 OF BRANCH E13 | 4536 |

RELATED ART

RELATED ART

DATA STRUCTURE OF BRANCH-STRUCTURED VECTOR DATA, BRANCH-STRUCTURED VECTOR DATA EDITING APPARATUS, AND EMBROIDERY DATA CREATION APPARATUS

CROSS-REFERENCE TO RELATED APPLICATION

This application claims priority from JP 2006-084955, filed Mar. 27, 2006, the content of which is hereby incorporated by reference.

BACKGROUND

The present disclosure relates to a data structure of a branch-structured vector data, a branch-structured vector data editing apparatus, a branch-structured vector data editing program recorded on a computer-readable recording medium, an embroidery data creation apparatus, and an embroidery data creation program recorded on a computer-readable recording medium, each of which may handle a plurality of thread colors and loop-shaped embroidery trajectories.

Conventionally, in order to embroider an image expressed as an image data, an embroidery data creation apparatus that creates embroidery data controls a needle in an embroidery sewing machine. For example, in an embroidery sewing machine disclosed in Japanese Patent Application Laid-Open Publication No. Hei 8-38756, a boundary line that defines a closed region of an image is first extracted from image data and subjected to line thinning processing. Then, based on the results of this processing, tree structure data is created, which is a tree structure version of embroidery trajectories. Such tree structure data is a set of vectors that indicate directions and lengths of needle strokes. Based on this tree structure data, underlying stitch sewing data ("running stitch sewing data" in the present disclosure) and stitch sewing data are created. Underlying stitch sewing ("running stitch sewing" in the present disclosure) refers to sewing that is performed in accordance with underlying stitch sewing data. Underlying stitch sewing is performed at a place, which will be hidden under stitch sewing (sewing that is performed in accordance with stitch sewing data), that forms a final embroidery result, in order to sew embroidery as in the case of single-stroke drawing, so that a thread may not be cut off or jump to a distant sewing position as much as possible. That is, underlying stitch sewing is covered by stitch sewing, thereby to complete an embroidery.

In this conventional embroidery data creation apparatus, the tree structure data is created for each of the thread colors. For example, in the case of embroidering with red and green threads, tree structure data of a red branch and of a green branch are created. Further, in some cases, rather than creating embroidery data directly from the tree structure data that was created from image data, an image and a vector of an embroidery result created from the tree structure data are displayed on a display screen, which are in turn edited by adding, deleting, or changing a vector (embroidery) in accordance with an instruction entered by a user. It should be noted that "changing" as referred to in this description includes changing a sewing method, moving an endpoint of a vector (node), changing of an inter-node path, changing a thickness, expanding, reducing and changing of a thread color.

SUMMARY

However, if tree structure data is created for each of the colors, it would be laborious to edit vectors of each of the different colors. For example, tree structure data, such as tree structure data 999 shown in FIG. 25 forms a character of "H" of a red thread. As shown in FIG. 25, the tree structure data 999 is composed of: a vector E201 directed from node N200 to node N201; a vector E202 directed from node N201 to node N202; a vector E203 directed from node N201 to node N203; a vector E204 directed from node N203 to node N204; and a vector E205 directed from node N203 to node N205. Embroidery data that is created from the tree structure data 999 is sewed in the following order: underlying stitch sewing from node N200 to node N201 (vector E201); underlying stitch sewing from node N201 to node N202 (vector E202); stitch sewing from node N202 to node N201 (vector E202); underlying stitch sewing from node N201 to node N203 (vector E203); underlying stitch sewing from node N203 to node N204 (vector E204); stitch sewing from node N204 to node N203 (vector E204); underlying stitch sewing from node N203 to node N205 (vector E205); stitch sewing from node N205 to node N203 (vector E205); stitch sewing from node N203 to node N201 (vector E203); and stitch sewing from node N201 to node N200 (vector E201).

For example, the vector E204 is changed to green. In this case, processing is first performed to cut off the vector E204 from the tree structure data 999, to subsequently create new green-thread tree structure data. To cut off the vector E204 from the tree structure data 999, it is necessary to change the information contained in the tree structure data 999 so that after underlying stitch sewing from node N201 to node N203 (vector E203), underlying stitch sewing from node N203 to node N205 (vector E205) may be performed in place of underlying stitch sewing from node N203 to node N204 (vector E204). Then, for the new green-thread tree structure data, data is created for performing underlying stitch sewing from node N203 to node N204 (vector E204) and stitch sewing from node N204 to node N203 (vector E204), in this order. If there already exists green-thread tree structure data, it is necessary to add information of the vector E204 to an appropriate position of the green-thread tree structure data. In this case, it is necessary to perform a processing that determines an "appropriate position" and cuts off an already existing vector to add the information to that position. That is, editing only to change a thread color requires changing a configuration of the tree structure data or an inter-vector connection, which may be troublesome and laborious.

Further, tree structure data, such as an embroidery pattern 990, is composed of three tree-structure data pieces, 996 through 998 shown in FIG. 26. The tree structure data 996 is of a green thread, the tree structure data 997 is of a yellow thread, and the tree structure data 998 is of a white thread. The embroidery using these three color threads result in a flower design (embroidery pattern 990). For example, a user would like to expand the embroidery pattern 990 (flower). The tree structure data 996, 997, and 998 for the respective color threads have already been created. Accordingly, there are no connections between the vectors having the different colors, the user needs to command expansion of the tree structure data pieces 996, 997, and 998 separately. Further, to move the embroidery pattern 990 as a whole, it is necessary to move the component patterns of these color threads independently of each other. If tree structure data has been created for each of color threads, the editing may be laborious as well as the processing may be troublesome in the apparatus.

Furthermore, in the case of expressing a vector by a tree structure, it may be impossible to start embroidering from one point and return (loop back) to this same point. For example, in the case of expressing a circle, rather than starting from one point and looping back to this same point, a curve may start from a first point and go to a second point, providing the same coordinates of the first and second points, to form a circle. Such an expression method requires performing two operations of moving a first point and moving a second point in order to perform one operation of moving a circle. If it is thus impossible to express loop-shaped embroidery, it may be laborious in editing.

Various exemplary embodiments of the broad principles derived herein provide a data structure of a branch-structured vector data, a branch-structured vector data editing apparatus, a branch-structured vector data editing program recorded on a computer-readable recording medium, an embroidery data creation apparatus, and an embroidery data creation program recorded on a computer-readable recording medium each of which may handle a plurality of thread colors and loop-shaped embroidery trajectories.

Exemplary embodiments provide a data structure of branch-structured vector data stored on a computer-readable recording medium that is created from line drawing information of an embroidery design and that is used by a computer to create an embroidery data, the embroidery data indicating strokes of a needle of an embroidery sewing machine by a computer. The data structure may include at least one branch data piece. The at least one branch data piece may include: identification information that identifies a branch and that is used to specify the branch, the branch being a path of embroidery connecting two endpoints, the two endpoints including a first endpoint and a second endpoint; sewing method information that indicates a method for sewing the branch as embroidery; and vector data that indicates a direction of the branch by positions of the first endpoint as an initial point and the second endpoint as a terminal point, that is used by the computer to specify a sewing position when creating running stitch sewing data and stitch sewing data. The running stitch sewing data is the embroidery data indicating running stitch sewing to be performed, and stitch sewing data is the embroidery data indicating stitch sewing to be performed over a path of the running stitch sewing in accordance with the sewing method indicated by the sewing method information. The at least one branch data piece may further include link information that is information about a link destination branch and that specifies the branch for which the embroidery data is to be created next and the link destination branch being a second branch linking to one of the endpoints, and thread color information that indicates a color of a sewing thread to be used when the branch is embroidered and that is used to determine whether to create the embroidery data of the link destination branch specified by the link information.

Exemplary embodiments provide a data structure of branch-structured vector data stored on a computer-readable recording medium that is created from line drawing information of an embroidery design and that is used by a computer to create an embroidery data indicating strokes of a needle of an embroidery sewing machine. The data structure may include at least one branch data piece. The branch data piece may include: at least identification information that identifies a branch and which is used to specify the branch, the branch being a path of embroidery connecting two endpoints, the two endpoints including a first endpoint and a second endpoint; sewing method information that indicates a method for sewing the branch as embroidery; and vector data that indicates a direction of the branch by positions of the first endpoint as an initial point and the second endpoint as a terminal point, and that is used by the computer to specify a sewing position when creating running stitch sewing data and stitch sewing data. The running stitch sewing data is the embroidery data indicating running stitch sewing to be performed, and stitch sewing data is the embroidery data indicating stitch sewing to be performed over a path of the running stitch sewing in accordance with the sewing method indicated by the sewing method information. The at least one branch data piece may further include link information that is information about a link destination branch, and specifies the branch for which the embroidery data is to be created next, the link destination branch being another branch lining to the endpoint, and loop information that indicates whether tracing the link destination branch of the endpoint results in generation of a loop that returns to the same endpoint, and that is used to determine whether to create the running stitch data of the link destination branch specified by the link information.

Exemplary embodiments provide a branch-structured vector data editing apparatus that edits branch-structured vector data created from line drawing information of an embroidery design. The apparatus may include: a display device that displays an image; a branch-structured vector data storage device that stores branch-structured vector data having a data structure comprising at least one branch data piece. The at least one branch data piece may include: least identification information that identifies a branch, the branch being a path of embroidery connecting two endpoints, the two endpoints including a first endpoint and a second endpoint; vector data that indicates a direction of the branch by positions of the first endpoint as an initial point and the second endpoint as a terminal point; link information that is information about a link destination branch, the link destination branch being another branch linking to the endpoint; sewing method information which indicates a method for sewing the branch as embroidery; and thread color information that indicates a color of a sewing thread to be used when the branch is embroidered. The apparatus may further include a display control device that causes the display device to display a schematic diagram of an embroidery result represented by the branch-structured vector data stored in the branch-structured vector data storage device; an edit instruction device that instructs editing of the branch-structured vector data by performing at least one of adding at least one additional branch to the branch representing the embroidery result, deleting, moving, expanding/shrinking, rotating, or dividing the branch, connecting the branch to another branch, altering the color or the method for sewing the branch, moving one of the endpoints, altering the path of the embroidery that connects the two endpoints, and replicating the branch; and a vector data editing device that edits the branch-structured vector data stored in the branch-structured vector data storage device in accordance with an instruction from the edit instruction device.

Exemplary embodiments provide a branch-structured vector data editing apparatus that edits branch-structured vector data created from line drawing information of an embroidery design. The apparatus may include: a display device that displays an image and a branch-structured vector data storage device that stores branch-structured vector data having a data structure including at least one branch data piece. The at least one branch data piece may include: identification information that identifies a branch, the branch being a path of embroidery connecting two endpoints, the two endpoints including a first endpoint and a second endpoint; vector data that indicates a direction of the branch by positions of the first endpoint as an initial point and the second endpoint as a terminal point; link information that is information about a link destination branch, the link destination branch being a second branch linking to one of the endpoints; and sewing method information that indicates a method for sewing the branch as embroidery; and loop information that indicates whether tracing the link destination branch of the one of the endpoints results in generation of a loop that returns to the one of the endpoints, the loop information including loop information pieces. The apparatus may further include: a display control device that causes the display device to display a schematic diagram of the branch-structured vector data, which represents an embroidery result, stored in the branch-structured vector data storage device; an edit instruction device that instructs editing of the branch-structured vector data by performing at least one of adding at least one additional branch to the branch representing the embroidery result, deleting, moving, expanding/shrinking, rotating, or dividing the branch, connecting the branch to another branch, altering the color or the method for sewing the branch, moving the endpoint, altering the path of the embroidery connecting the two endpoints, and replicating the branch; and a vector data editing device that edits the branch-structured vector data stored in the branch-structured vector data storage device in accordance with an instruction from the edit instruction device.

Exemplary embodiments include a branch-structured vector data editing program that is recorded on a computer-readable recording medium and executable by a computer, the program usable to edit branch-structured vector data created from line drawing information of an embroidery design. The program may include instructions for displaying a schematic diagram of branch-structured vector data, which represents an embroidery result, having a data structure including at least one branch data piece. The at least one branch data piece may include: identification information that identifies a branch, the branch being a path of embroidery connecting two endpoints, the two endpoints including a first endpoint and a second endpoint; vector data that indicates a direction of the branch by positions of one of the first endpoint as an initial point and the second endpoint as a terminal point; link information that is information about a link destination branch, the link destination branch being another branch linking to the endpoint; sewing method information that indicates a method for sewing the branch as embroidery; and thread color information that indicates a color of a sewing thread to be used when the branch is embroidered. The program may further include: instructions for issuing an edit instruction to perform at least one of adding at least one additional branch to the branch that represents the embroidery result, deleting, moving, expanding/shrinking, rotating, or dividing the branch, connecting the branch to another branch, altering the color or the method for sewing the branch, moving one of the endpoints altering the path of the embroidery connecting the two endpoints, and replicating the branch; and instructions for editing the branch-structured vector data in accordance with the instruction issued in instructions for issuing the edit instruction.

Exemplary embodiments include a branch-structured vector data editing program that is recorded on a computer-readable recording medium and executable by a computer, the program usable to edit branch-structured vector data created from line drawing information of an embroidery design. The program may include instructions for displaying a schematic diagram of branch-structured vector data, which represents an embroidery result having a data structure including at least one branch data piece. The at least one branch data piece may include: identification information that identifies a branch, the branch being a path of embroidery connecting two endpoints, the two endpoints including a first endpoint and a second endpoint; vector data that indicates a direction of the branch by positions of the first endpoint as an initial point and the second endpoint as a terminal point; link information that is information about a link destination branch, the link destination branch being another branch linking to the endpoint; sewing method information that indicates a method for sewing the branch as embroidery; and loop information that indicates whether tracing a link destination branch of one of the endpoint results in generation of a loop that returns to the one of the endpoints, the loop information including loop information pieces. The program may further include: instructions for issuing an edit instruction to perform at least one of adding at least one additional branch to the branch that represents the embroidery result, deleting, moving, expanding/shrinking, rotating, or dividing the branch, connecting the branch to another branch, altering the color or the method for sewing the branch, moving the endpoint, altering the path of the embroidery connecting the two endpoints, and replicating the branch; and instructions for editing the branch-structured vector data in accordance with the instruction issued in the instructions for issuing the edit instruction.

BRIEF DESCRIPTION OF THE DRAWINGS

Exemplary embodiments will be described below in detail with reference to the accompanying drawings in which:

FIG. 7 is a schematic diagram showing a configuration of a branch-structured vector data;

FIG. 8 is a schematic diagram showing contents of embroidery data for a green thread;

FIG. 10 is a schematic diagram showing a configuration of the branch-structured vector data;

FIG. 11 is a schematic diagram showing contents of embroidery data for a green thread;

FIG. 15 is a schematic diagram showing a configuration of branch-structured vector data;

FIG. 16 is a schematic diagram showing a configuration of another piece of branch-structured vector data;

FIG. 18 is a schematic diagram showing a configuration of a further piece of branch-structured vector data;

FIG. 19 is a schematic diagram showing contents of embroidery data;

FIG. 22 is a schematic diagram showing a configuration of branch-structured vector data under editing when a branch has been divided;

FIG. 23 is a schematic diagram showing a configuration of a branch-structured vector data after a branch has been divided;

FIG. 24 is a schematic diagram showing contents of embroidery data which is created from a branch-structured vector data;

DETAILED DESCRIPTION OF EMBODIMENTS

Hereinafter an embroidery data creation apparatus 1 according to exemplary embodiments will be described with reference to drawings. The embroidery data creation apparatus 1 may be used to create embroidery data required to output image data that represents a design that may be embroidered by an embroidery sewing machine 3 based on the image data. Further, the embroidery data creation apparatus 1 may function as a "branch-structured vector data editing apparatus" that edits branch-structured vector data, which is utilized in the middle of creating embroidery data from image data. The structure of the embroidery sewing machine 3 will be described below.

Figure 1:
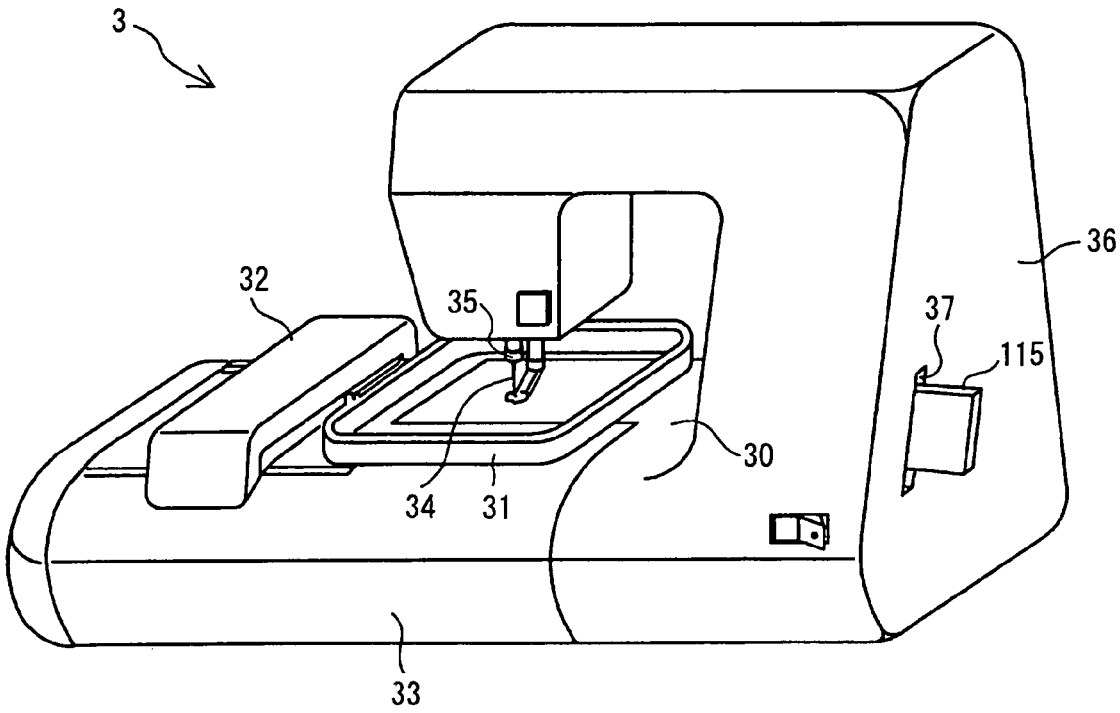
FIG. 1 is an external view of an embroidery sewing machine.

As shown in FIG. 1, the embroidery sewing machine 3 may move an embroidery frame 31 that is placed on a sewing machine bed 30 to hold a work cloth to be embroidered, to a predetermined position indicated by an X-Y coordinate system specific to the apparatus, using a Y-directional drive section 32 and an X-directional drive mechanism (not shown), which may be contained within a body case 33. Meanwhile, by using a sewing needle 34 and an shuttle mechanism (not shown), embroidery of a predetermined design may be sewn onto this work cloth. The Y-directional drive section 32, the X-directional drive mechanism (not shown), a needle bar 35, may be controlled by a control device (not shown) that includes, for example, a microcomputer built into the embroidery sewing machine 3. The embroidery sewing machine 3 may include a memory card slot 37 formed on a side surface of a pillar 36. By inserting a memory card 115, in which embroidery data is stored, into the memory card slot 37, embroidery data created by the embroidery data creation apparatus 1 may be supplied.

Figure 2:
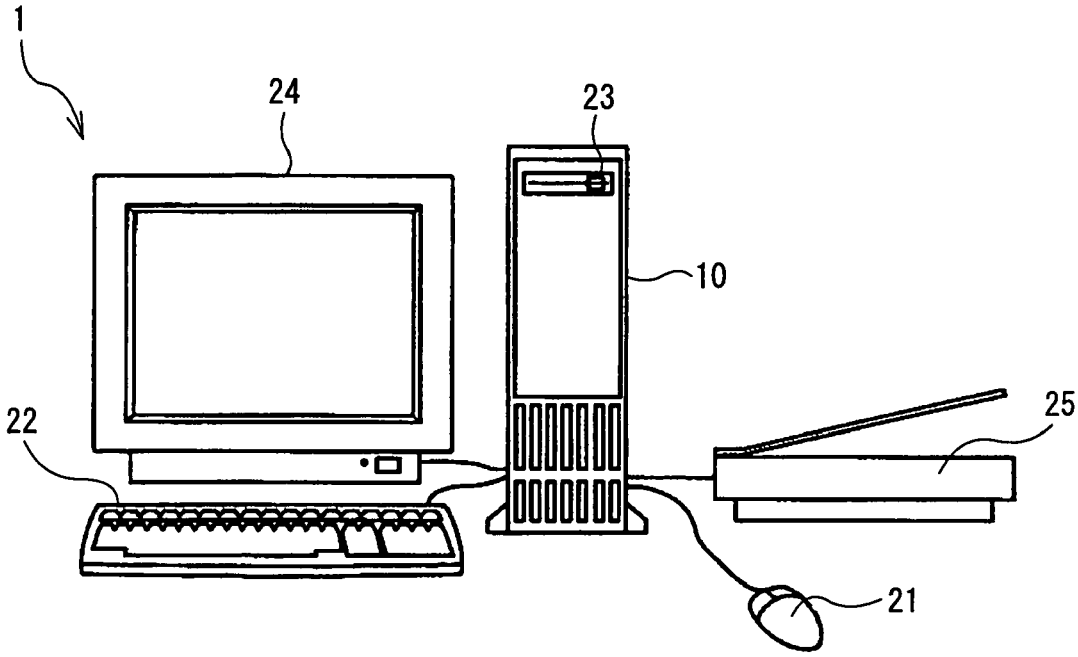
FIG. 2 is an overall configuration diagram showing a physical configuration of an embroidery data creation apparatus.

Next, the embroidery data processing apparatus 1 will be described with reference to FIG. 2. As shown in FIG. 2, the embroidery data processing apparatus 1 may include a main frame 10, which may be a personal computer, a mouse 21, a keyboard 22, a memory card connector 23, a display 24, and an image scanner 25, which may be connected to the main frame 10. The configuration and type of the main frame 10, the mouse 21, the keyword 22, the memory card connector 23, the display 24, and the image scanner 25 are not limited to those shown in FIG. 2. For example, the main frame 10 is not limited to a tower configuration and may have a horizontal configuration or may be a laptop in which the main frame 10 is integrated with the display 24 and the keyboard 22. Further, of course, the main frame 10 may not be a personal computer and may be a machine dedicated to embroidery.

Figure 3:
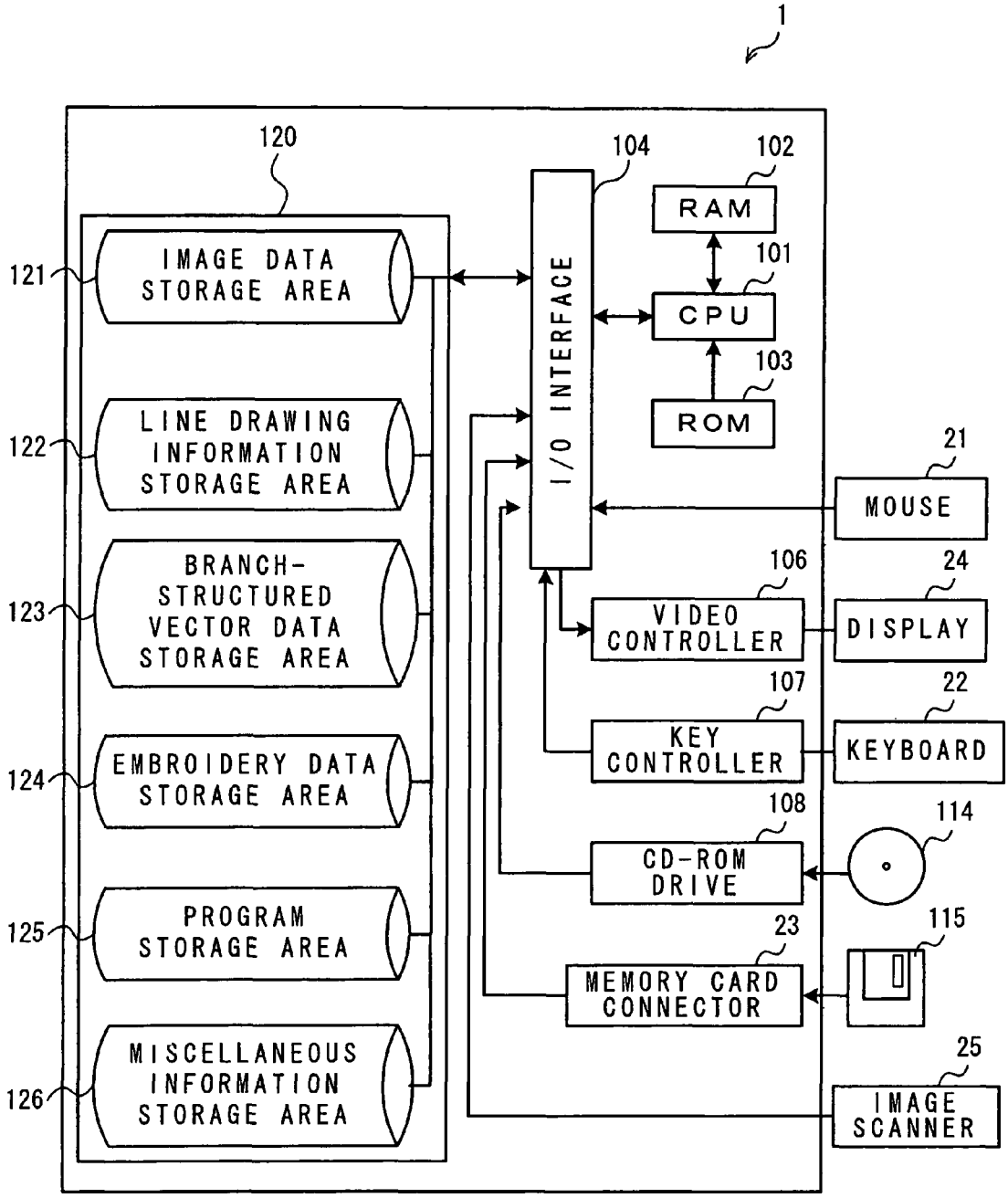
FIG. 3 is a block diagram showing an electrical configuration of the embroidery data creation apparatus.

Next, the electrical configuration of the embroidery sewing machine 1 will be described with reference to FIG. 3. As shown in FIG. 3, the embroidery data creation apparatus 1 may be equipped with a CPU 101 as a controller that controls the embroidery data creation apparatus 1. To the CPU 101, a RAM 102 in which a variety of kinds of data may be stored temporarily, a ROM 103 in which a BIOS for example, may be stored, and an I/O interface 104 that mediates transfer of data may be connected. To the I/O interface 104, a hard disk device 120 may be connected. The hard disk device 120 may include at least an image data storage area 121, a line drawing information storage area 122, a branch-structured vector data storage area 123, an embroidery data storage area 124, a program storage area 125, and a miscellaneous information storage area 126.

The image data storage area 121 may store image data 100 (see FIG. 4) read by the image scanner 25. The line drawing information storage area 122 may store line drawing information 200 (see FIG. 4) created from the image data 100. The branch-structured vector data storage area 123 may store branch-structured vector data 300 (see FIG. 4) created from the line drawing information 200. The embroidery data storage area 124 may store embroidery data 400 (see FIG. 4) created from the branch-structured vector data 300. And, in the program storage area 125, a branch-structured vector data editing program and an embroidery data creation program, which may be executed by the CPU 101, may be stored. In the miscellaneous information storage area 126, miscellaneous information, which is used in the embroidery data creation apparatus 1, may be stored. If the embroidery data creation apparatus 1 is not equipped with the hard disk device 120, the programs may be stored in the ROM103.

Further, to the I/O interface 104, the mouse 21, a video controller 106, a key controller 107, a CD-ROM drive 108, the memory card connector 23, and the image scanner 25 may be connected. To the video controller 106, the display 24 may be connected, and to the key controller 107, the keyboard 22 may be connected. A CD-ROM 114, which may be inserted into the CD-ROM drive 108, may store a branch-structured vector data editing program and an embroidery data creation program, which may be a control program for the embroidery data creation apparatus 1. The control program may be stored into the hard disk device 120 from the CD-ROM 114 and more specifically, may be stored into the program storage area 125. Further, at the memory card connector 23, information may also be read from and written to a memory card 115.

Figure 4:
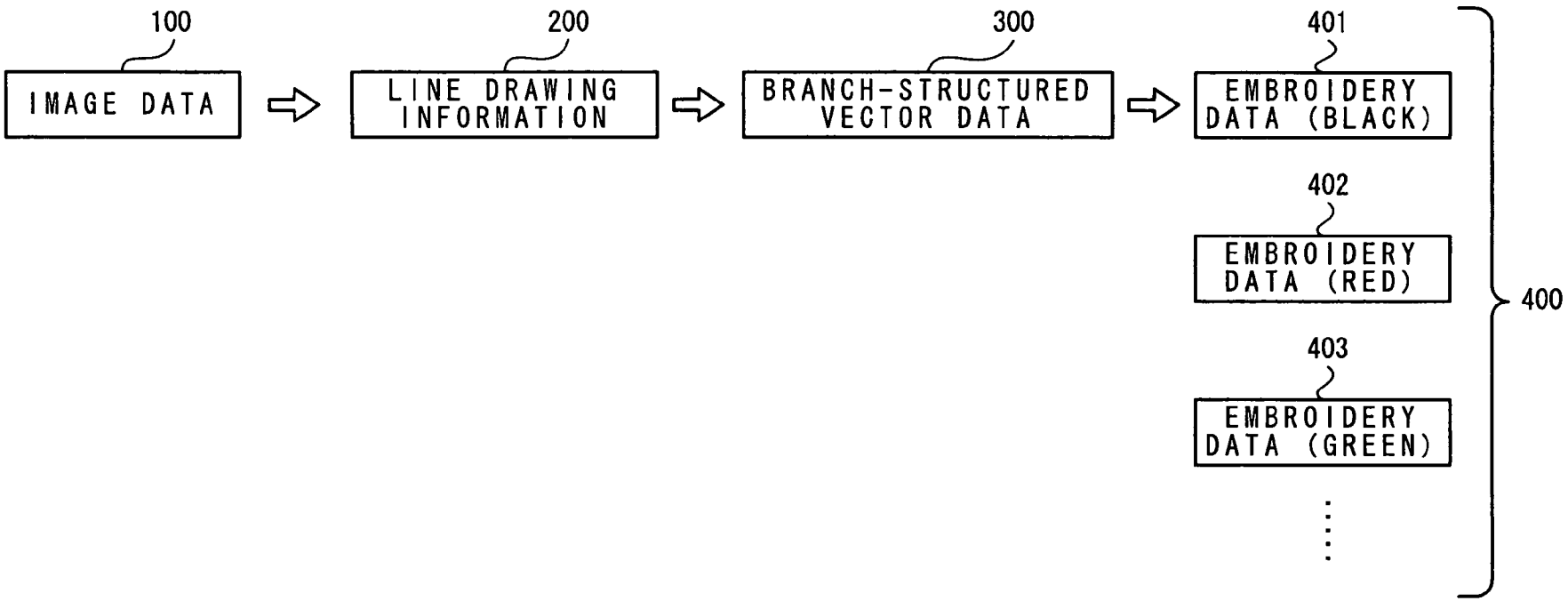
FIG. 4 is a diagram showing the relationship between information.

Next, information and its relationships, which are utilized in creation of embroidery data, will be described with reference to FIG. 4. As shown in FIG. 4, the line drawing information 200, which shows an image of trajectories constituting embroidery, may be created from the image data 100 read by the image scanner 25. Then, from the line drawing information 200, branch-structured vector data 300 may be created. By executing the embroidery data creation program, embroidery data 400 may be created from the branch-structured vector data 300 for each of thread colors of embroidery threads. For each of the thread colors, the embroidery data pieces 400 may be created, for example, embroidery data 401 for black, embroidery data 402 for red, and embroidery data 403 for green as shown in FIG. 4. The branch-structured vector data 300 may be displayed on the display 24 by the branch-structured vector data editing program and may be edited in accordance with an edit instruction entered through the mouse 21 or the keyboard 22. That is, a user may enter the edit instruction through the mouse 21 or the keyboard 22 to thereby edit the branch-structured vector data 300. Editing of the branch-structured vector data 300 may include adding a branch, deleting a branch, moving a branch, expanding a branch, shrinking a branch, rotating a branch, or cutting off a branch, connecting a branch to another branch, altering a color or a method for sewing a branch, moving an endpoint of a branch, altering a path of embroidery to interconnect two endpoints, replicating a branch, etc. A branch corresponds to the trajectory of the embroidery.

The image data 100 may also be read from the memory card 115 or the CD-ROM 114 or created by image creation software.

Figure 5:
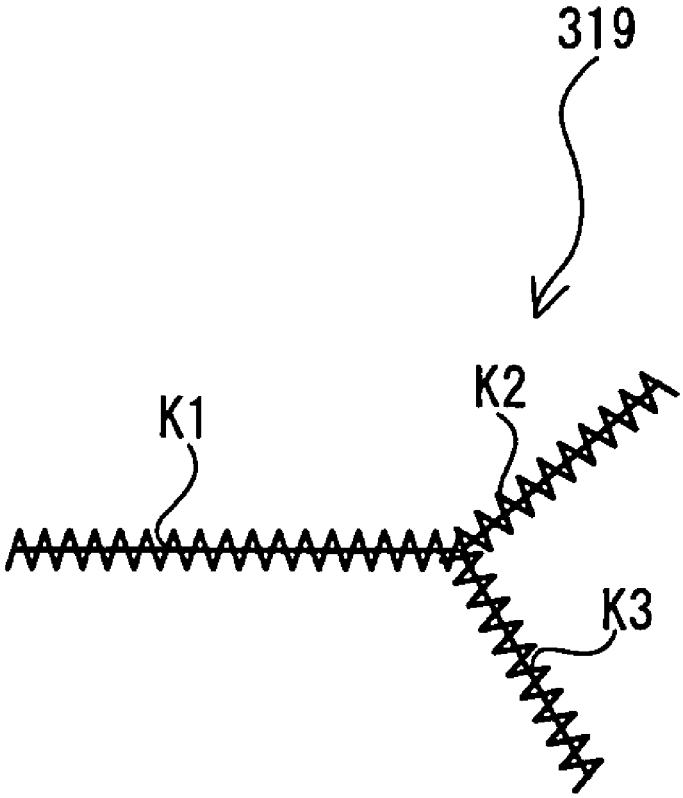
FIG. 5 is a diagram showing results of embroidering.

Next, branch-structured vector data 310, which is an example of the branch-structured vector data 300, will be described with reference to FIGS. 5 through 8. As shown in FIG. 5, an embroidery result 319 may be configured by three linear embroidery trajectories K1, K2, and K3. The branch-structured vector data 310 of the embroidery result 319 may be schematized as shown in a vector diagram 411 of FIG. 6. In the branch-structured vector data 310, one embroidery trajectory corresponds to one branch." A branch E1 shown in FIG. 6 corresponds to the embroidery trajectory K1 shown in FIG. 5, a branch E2 shown in FIG. 6 corresponds to the embroidery trajectory K2 shown in FIG. 5, and a branch E3 shown in FIG. 6 corresponds to the embroidery trajectory K3 shown in FIG. 5.

Then, as shown in FIG. 7, in the branch-structured vector data 310, a record may be created for each of these branches and various pieces of information may be stored for each of the branches. The record for each of the branches is hereinafter referred to as "branch data." The branch-structured vector data 310 may include a branch data no. field in which information that identifies the branches may be stored. The branch-structured vector data 310 of the embroidery result 319 shown in FIG. 5 may be composed of the three branch data pieces.

Each of these branches E1, E2, and E3 correspond to a vector. As shown in FIG. 7, the branch-structured vector data 310 may also include a vector data field, in which information for a vector that represents the branch E1 may be stored. Information for a vector to be stored in the vector data field may include, for example, coordinates of an initial point and a terminal point, or a coordinate of an initial point and a direction (angle) from the initial point and length of a vector. With reference to the vector diagram 411 shown in FIG. 6, the branch E1 may be a vector directed from a point N0 to a point N1, the branch E2 may be a vector directed from the point N1 to a point N2, and the branch E3 may be a vector directed from a point N3 to the point N1. That is, the branches E1, E2, and E3 may share the point N1 as a terminal point or an initial point and may be connected (linked) to each other at the point N1.

The following will describe how link relationships among the branches E1, E2, and E3 may be represented in the branch-structured vector data 310. The branch-structured vector data 310 may include initial point link information field and a terminal point link information field. The initial point link information field may include a link destination branch identification information field and a link destination branch endpoint information field, which may store information about an endpoint of another branch to which a starting point of a branch is linked (hereinafter referred to as "link destination branch"). In the link destination branch identification information field, information that identifies a link destination branch may be stored, and in the link destination branch endpoint information field, information that indicates which one of the endpoints of a link destination branch, a branch is to be linked to, may be stored. Hereinafter, a linked endpoint on a link destination branch is referred to as "link destination endpoint." Furthermore, the initial point link destination information field includes loop information field. In this loop information field, information may be stored, that indicates whether tracing a link destination branch results in generation of a loop that returns to itself (initial point of the relevant branch data).

Similar to the initial point link information field, in the terminal point link information field, information of a link destination branch and loop information of terminal point of a branch of this branch data, are stored. It should be noted that this loop is described in detail later with reference to FIGS. 13 through 18.

The branch-structured vector data 310 may further include a sewing method information field and a thread color information field 326. In the sewing method information field, a method may be stored for sewing embroidery of a relevant branch, and in the thread color information field, a color may be stored of a thread that is employed when embroidering the relevant branch.

Figure 6:
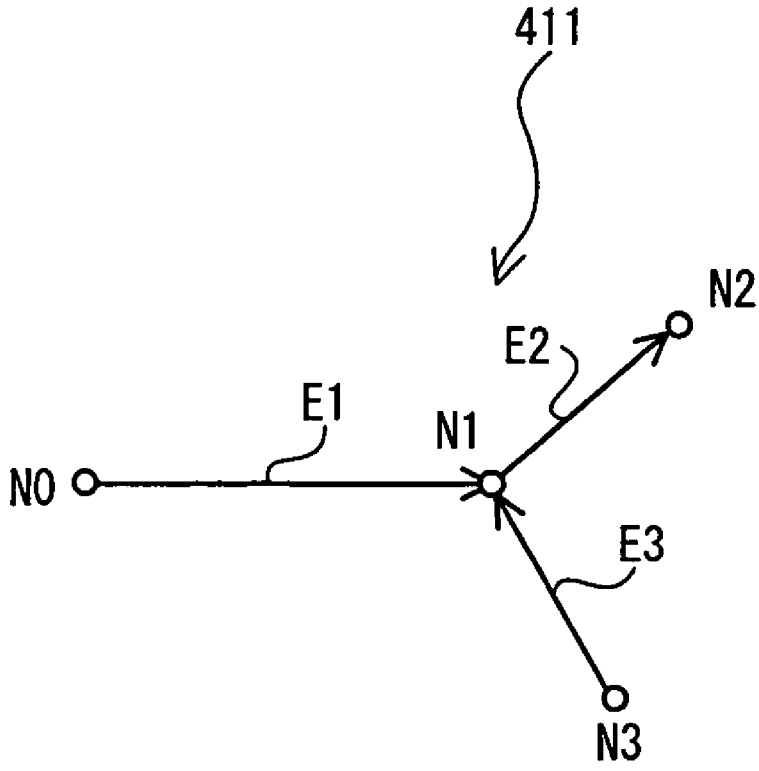
FIG. 6 is a vector diagram showing schematized branch-structured vector data.
Figure 9:
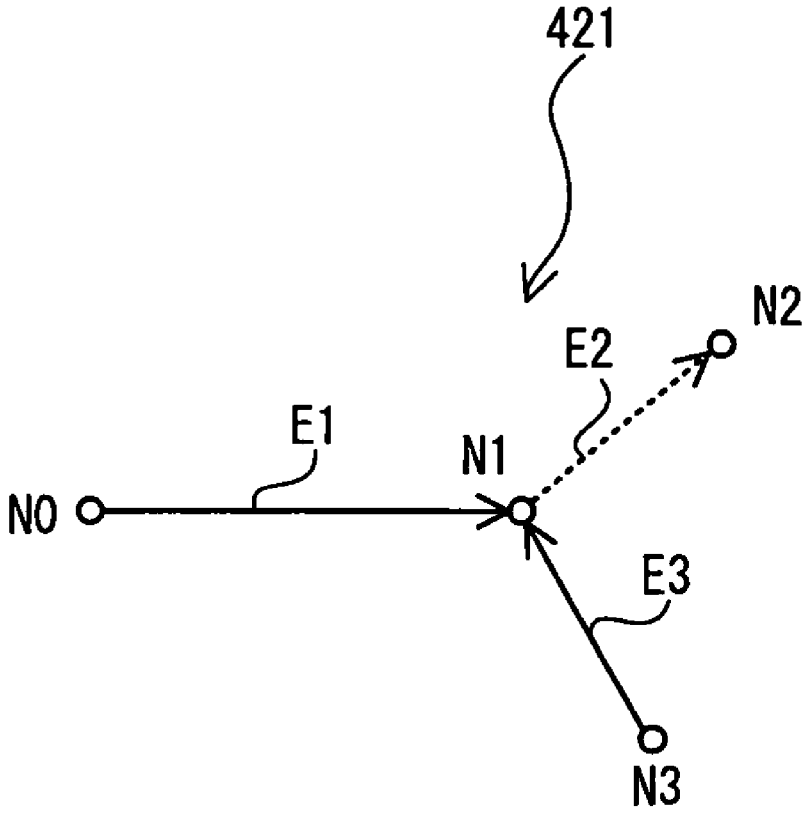
FIG. 9 is another vector diagram in which branch-structured vector data is schematized.
Figure 12:
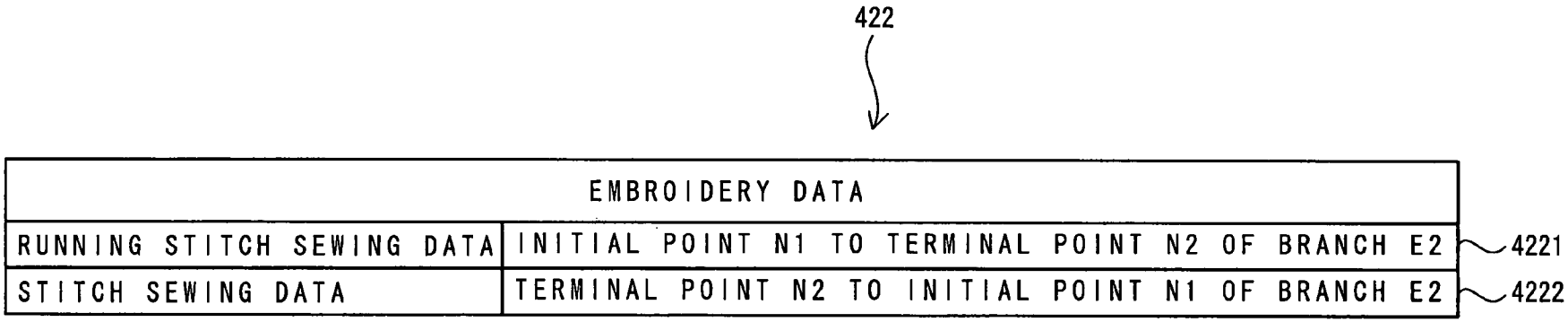
FIG. 12 is a schematic diagram showing contents of embroidery data for a red thread.

The following will specifically describe link relationships of the branches with reference to FIGS. 6 and 7. For example, the branch data for branch data number "E1," the initial point link information field stores no information of a link destination branch and indicates "not provided" because there is no link destination branch at the initial point of the branch E1. In the terminal point link information field, the link destination branch identification field indicates "E2," the link destination branch endpoint information field indicates "initial point," and the loop information field indicates "no loop." Accordingly, the terminal point of the branch E1 may link to the initial point of the branch E2, and no loop may be generated. The sewing method information field indicates a "zigzag" stitch and the thread color information field indicates "green." Subsequently, in the branch data of branch data number "E2," in the initial point link information field, the link destination branch identification information field indicates "E3," the link destination branch endpoint information field indicates "terminal point," and the loop information field indicates "no loop." Accordingly, the initial point of the branch E2 links to the terminal point of the branch E3, to generate no loop. Further, the terminal point link information field of the branch E2 stores no information of the link destination branch, because there is no link destination branch at the terminal point of the branch E2. The sewing method information field indicates a "zigzag" stitch and the thread color information field is "green." Subsequently, in the branch data for branch data number "E3," information of a link destination branch is not stored in the initial point link information field or the terminal point link information field, so that it is known that there is no link destination branch at the initial point or the terminal point of the branch E3. The sewing method information field indicates a "zigzag" stitch and the thread color information field indicates "green."

The following will describe the embroidery data 400, which may be created from the branch-structured vector data 300. The embroidery data 400 may be composed of "running stitch sewing data" and "stitch sewing data." The "running stitch sewing data" is embroidery data, which is used for running stitch sewing, and the "stitch sewing data" is embroidery data, which is used for stitch sewing. An embroidery result may be formed by single-stroke drawing by sewing one branch twice so that embroidering may not be discontinued to cut off a thread or restart embroidering at a distant point. Therefore, each first-time sewn branch may be hidden by second-time-sewing thereof. This first-time sewing is the "running stitch sewing" and the second-time sewing is the "stitch sewing."

Next, operations for creating green embroidery data 413 shown in FIG. 8 from the branch-structured vector data 310 shown in FIG. 7 will be described with reference to FIGS. 6 through 8. Creation of the embroidery data 413 may be performed by executing the embroidery data creation program in the embroidery data creation apparatus 1. First, the branch-structured vector data 310 may be searched for a starting point of a start branch at which embroidering is to start. Specifically, start branch, which is not to be of a link destination, may be searched for among all the branches. Then, an arbitrary endpoint of this branch may be made to be the starting point. For example, N0, which is the initial point of the branch E1, is employed as the starting point.

Because the initial point N0 of the branch E1 is the starting point, branch data of the branch E1 may be read first. Then, the thread color information field may be read to determine whether it indicates "green," which is a thread color of embroidery data being created currently. Because the thread color information of the branch E1 is "green," running stitch sewing data 4131 may be created, which is used to perform running stitch sewing from the initial point N0 to the terminal point N1 of the branch E1. Subsequently, information of a link destination of the terminal point N1 of the branch E1, which is an embroidery ending point of the created running stitch sewing data 4131, may be read from endpoint link information of the branch E1. As shown in FIG. 7, the link destination of the terminal point N1 of the branch E1 may be the initial point N1 of the branch E2. Accordingly, branch data of the branch E2 is read.

Then, because the thread color information of the branch E2 is "green," running stitch sewing data 4132 may be created, which is used to perform running stitch sewing from the initial point N1 to the terminal point N2 of the branch E2. Subsequently, information of a link destination of the terminal point N2 of the branch E2, which is an embroidery ending point of the running stitch sewing data 4132, may be read from the terminal point link information field of the branch E2. As shown in FIG. 7, the terminal point N2 of the branch E2 has no link destination. Accordingly, stitch sewing data 4133 may be created for sewing from the terminal point N2 to the initial point N1 of the branch E2. The sewing method employed may be a zigzag stitch.

Then, information of a link destination of the initial point N1 of the branch E2, which is an embroidery ending point of the stitch sewing data 4133, may be read from initial point link information field of the branch E2. As shown in FIG. 7, a link destination of the initial point N1 of the branch E3 may be the terminal point N1 of the branch E3. Accordingly, branch data of the branch E3 may be read. Running stitch sewing data of this branch E3 is not created yet and the thread color information is "green," so that running stitch sewing data 4134 may be created for sewing from the terminal point N1 to the initial point N3 of the branch E3. Accordingly, information of a link destination of the initial point N3 of the branch E3, which is an embroidery ending point of the created running stitch sewing data 4134, may be read from initial point link information field of the branch E3. Because the initial point N3 of the branch E3 has no link destination, stitch sewing data 4135 may be created for sewing from the initial point N3 to N1 to the terminal point N1 of the branch E3. The sewing method employed may be zigzag stitch.

Then, information of a link destination of the terminal point N1 of the branch E3, which is an embroidery ending point of the stitch sewing data 4135, may be read from terminal point link information field of the branch E3. As shown in FIG. 7, the terminal point N1 of the branch E3 has no link destination. Accordingly, the initial point link information field or terminal point link information field (hereinafter referred to as "link source") that have the terminal point N1 of the branch E3 as a link destination may be searched for. As shown in FIG. 7, the initial point link information field of the branch E2 has the terminal point N1 of the branch E3 as a link destination. Although the thread color information of the branch E2 is "green," stitch sewing data of the branch E2 (stitch sewing data 4133) is already created, so that it may be unnecessary to create it again. Accordingly, the initial point link information field or terminal point link information field that have the initial point N1 of the branch E2 as a link destination (link source of the branch E2) may be further searched for. As shown in FIG. 7, terminal point link information field of the branch E1 has the initial point N1 of the branch E2 as a link destination. Because the thread color information of the branch E1 is "green," it may determine whether to create stitch sewing embroidery data for the branch E1. Because stitch sewing embroidery data has not been created for the branch E1, stitch sewing embroidery data 4136 may be created for sewing from the terminal point N1 to the initial point N0 of the branch E1.

Then, when the stitch sewing embroidery data 4136 is created for sewing from the terminal point N1 to the initial point N0 of the branch E1, it may determine whether to further create embroidery data for sewing from the initial point N0 of the branch E1, which is an embroidery ending point of the stitch sewing data 4136. However, because N0 is the starting point of the embroidery data, embroidery data needs not to be created any more. Through such processing, for each of the branches E1, E2, and E3, running stitch sewing data may be created, followed by stitch sewing data. By causing the embroidery sewing machine to perform embroidering based on this embroidery data, it may be possible to obtain such an embroidery result as shown in FIG. 5 without interrupting the embroidering.

Next, embroidery that uses a plurality of colors of embroidery threads will be described with reference to FIGS. 9 through 12. For example, a thread color of the branch E2 of embroidery shown in FIGS. 5 through 7 is "red." In FIG. 9, a vector of a branch to be embroidered with a red thread is indicated by a dotted line. Further, as shown in FIG. 10, the thread color information field in the branch data of the branch E2 of the branch-structured vector data 320 may indicate "red."

The following will describe operations of creating the embroidery data 423 from the branch-structured vector data 320. Creation of the embroidery data 423 for a green embroidery thread will first be described. Creation of the embroidery data 423 may be performed by executing the embroidery data creation program in the embroidery data creation apparatus 1. First, the branch-structured vector data 320 may be searched for a starting point of a start branch at which embroidering is to start. Specifically, a start branch, which is not a link destination, may be searched for among all the branches, to obtain an arbitrary endpoint of the start branch to be the starting point. For example, N0, which is the initial point of the branch E1, may be employed as the starting point.

Because the initial point N0 of the branch E1 is the starting point, branch data of the branch E1 may be read first. Then, thread color information field may be accessed to determine whether it indicates "green," which is a thread color of embroidery data 423 being created currently. Because the thread color information field of the branch E1 is "green," running stitch sewing data 4231 may be created, which is used to perform running stitch sewing from the initial point N0 to the terminal point N1 of the branch E1. Subsequently, information of a link destination of the terminal point N1 of the branch E1, which is an embroidery ending point of the created running stitch sewing data 4231, may be read from terminal point link information field of the branch E1. As shown in FIG. 10, the link destination of the terminal point N1 of the branch E1 may be the initial point N1 of the branch E2. Accordingly, branch data of the branch E2 may be read.

Then, thread color information field may be read to determine whether it indicates "green," which is the thread color of the embroidery data 423 being created currently. Because the thread color information of the branch E2 is "red," running stitch sewing data may not created for sewing from the initial point N1 to the terminal point N2 of the branch E2.

Subsequently, information of a link destination of the initial point N1 of the branch E2 may be read from initial point link information field of the branch E2. As shown in FIG. 10, the link destination of the initial point N1 of the branch E2 may be the terminal point N1 of the branch E3. Accordingly, branch data of the branch E3 may be read. Then, thread color information field may be accessed to determine whether it indicates "green," which is the thread color of embroidery data 423 being created currently. Because the thread color information is "green" and running stitch sewing data for the branch E3 has not been created yet, running stitch sewing data 4232 may be created for sewing from the terminal point N1 to the initial point N3 of the branch E3.

Subsequently, information of a link destination of the initial point N3 of the branch E3, which is an embroidery ending point of the created running stitch sewing data 4232, may be read from initial point link information field of the branch E3. Because the initial point N3 of the branch E3 has no link destination, stitch sewing data 4233 may be created for sewing from the initial point N3 to the terminal point N1 of the branch E3. The sewing method employed may be zigzag stitch.

Then, information of a link destination of the terminal point N1 of the branch E3, which is an embroidery ending point of the running stitch sewing data 4233, may be read from terminal point link information field of the branch E3. As shown in FIG. 10, the terminal point N1 of the branch E3 may have no link destination. Accordingly, such initial point link information or terminal point link information (link source), which have the terminal point N1 of the branch E3 as a link destination, may be searched for. As shown in FIG. 10, the initial point link information of the branch E2 may have the terminal point N1 of the branch E3 as a link destination. Because the thread color information of the branch E2 is "red," no stitch sewing data may be created. Accordingly, the link source of the initial point N1 of the branch E2 may be further searched for. As shown in FIG. 10, the terminal point link information of the branch E1 may have the initial point N1 of the branch E2 as a link destination. Accordingly, branch data of the branch E1 may be read to access to the thread color information field and may determine that it indicates "green," which is the thread color of the embroidery data 423 being created currently. Because the thread color information of the branch E1 is "green," stitch sewing data may be created. Further, because stitch sewing data of the branch E1 has not been created yet, stitch sewing data 4234 may be created for sewing from the terminal point N1 to the initial point N0 of the branch E1.

Then, when the stitch sewing embroidery data 4234 is created for sewing from the terminal point N1 to the initial point N0 of the branch E1, it may determine whether to further create embroidery data for sewing from the initial point N0 of the branch E1, which is an embroidery ending point of the stitch sewing data 4234. Because the initial point N0 is the starting point of this embroidery data, embroidery data may no longer be created. The processing may create stitch sewing data after running stitch sewing data is created for each of the branches E1 and E3, each of which has a "green" thread color, so that no embroidery data may be created for the branch E2, which has a "red" thread color.

Next, creation of embroidery data 422 for a red embroidery thread will be described. Because the initial point N0 of the branch E1 is the starting point, the branch data of the branch E1 may be read first. Then, thread color information field may be read to determine whether it indicates "red," which is a thread color of the embroidery data 422 being created currently. Because the thread color information of the branch E1 is "green," running stitch sewing data may not be created, which is used to perform running stitch sewing from the initial point N0 to the terminal point N1 of the branch E1. Subsequently, information of a link destination of the terminal point N1 of the branch E1 may be read from terminal point link information field of the branch E1. As shown in FIG. 10, the link destination of the terminal point N1 of the branch E1 may be the initial point N1 of the branch E2. Accordingly, branch data of the branch E2 may be read.

Then, the thread color information field may be accessed to determine whether it indicates "red," which is the thread color of the embroidery data 422 being created currently. Because the thread color information of the branch E2 is "red," running stitch sewing data 4221 may be created for sewing from the initial point N1 to the terminal point N2 of the branch E2. Subsequently, information of a link destination of the terminal point N2 of the branch E2, which is an embroidery ending point of the running stitch sewing data 4221, may be read from terminal point link information field of the branch E2. As shown in FIG. 10, the terminal point N2 of the branch E2 has no link destination, so that stitch sewing data 4222 may be created for sewing from the terminal point N2 to the initial point N1 of the branch E2. The sewing method employed may be zigzag stitch.

Then, information of a link destination of the initial point N1 of the branch E2, which is an embroidery ending point of the stitch sewing data 4222, may be read from initial point link information field of the branch E2. As shown in FIG. 10, a link destination of the initial point N1 of the branch E2 may be the terminal point N1 of the branch E3. Because the thread color information of this branch E3 is "green," running stitch sewing data of sewing from the terminal point N1 to the initial point N3 of the branch E3 may not be created. Accordingly, information of a link destination of the terminal point N1 of the branch E3 may be read from terminal point link information field of the branch E3. As shown in FIG. 10, the terminal point N1 of the branch E3 has no link destination.

Therefore, a link source of the terminal point N1 of the branch E3 may be searched for. Although, as shown in FIG. 10, the initial point link information field of the branch E2 may have the terminal point N1 of the branch E3 as a link destination and the thread color information of the branch E2 may be "red," stitch sewing data for the branch E2 is already created, so that stitch sewing data may no longer be created. Accordingly, a link source of the initial point N1 of the branch E2 may be searched for further. Although, as shown in FIG. 10, terminal point link information field of the branch E1 may have the initial point N1 of the branch E2 as a link destination, the thread color information of the branch E1 may be "green," so that stitch sewing data may not be created. Further, the initial point N0, which is an endpoint opposite to the terminal point of the branch E1, may be a data starting point, so that embroidery data may no longer be created. Through such processing, running stitch sewing data is created, followed by stitch sewing data only for the branch E2 that has a "red" thread color. On the other hand, embroidery data for the branch E1 or E3 that has a "green" thread color may not be created.

By using thread color information, it may be possible to create embroidery data pieces 422 and 423 for each of a plurality of thread colors from branch-structured vector data 320 composed of branch data pieces of these colors.

Figure 13:
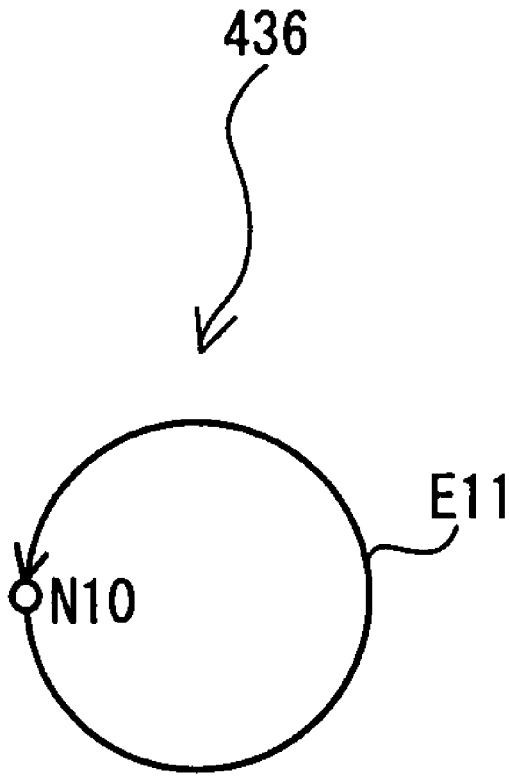
FIG. 13 is a vector diagram showing a branch not involving generation of a loop.

Next, a branch E11 that involves generation of a loop will be described with reference to FIGS. 13 and 15. As shown in FIG. 13, the branch E11 may start at a point N10 as an initial point, go along a roughly circular trajectory and end at the same point N10 as a terminal point. That is, it may return from the point N10 to the point N10. Branch data of the branch E11 may be as shown in branch-structured vector data 331 of FIG. 15. "E11" may be stored in the branch data number field, no information may be stored in the initial point link information field and in the terminal point link information field, "E11" may be stored in the link destination branch identification information field, "initial point" may be stored in the link destination branch endpoint information field, and "provided" may be stored in the loop information field. "Zigzag" may be stored in the sewing method information field and "green" may be stored in the thread color information field.

Creation of embroidery data of the branch E11 that involves generation of such a loop is now considered. If the initial point N10 of the branch E11 is a starting point, running stitch sewing data may be created first for sewing from the initial point N10 to the terminal point N10 of the branch E11. Then, terminal point link information field of E11 may be read. As shown in FIG. 15, a link destination of the terminal point N10 of E11 may be the initial point N10 of the branch E11. If the process goes to the initial point N10 of E11 to create running stitch sewing data for sewing from the initial point N10 to the terminal point N11 of E11, it may enter an endless loop. To avoid this, the loop information field may be used. Running stitch sewing data may be created for sewing from the initial point N10 to the terminal point N10 of the branch E11 and, to determine the processing to be performed next. The loop information field for the terminal point N10 of E11 may be read before reading the link destination branch identification information field and the link destination branch endpoint information field for the terminal point N10 of E11. If a value that indicates generation of a loop is stored in the loop information field, the process may not trace the link any more and turns back to create stitch sewing embroidery data. In an example of FIG. 15, stitch sewing data may be created for sewing from the terminal point N10 to the initial point N10 of E11. After the stitch sewing data is created for sewing from the terminal point N10 to the initial point N10 of E11, creation of the embroidery data may end because the initial point N10 of E11 is a starting point of this embroidery data.

In such a manner, even if there is a branch that involves generation of a loop that returns from a point to the same point, by utilizing loop information, it may be possible to create running stitch sewing data and stitch sewing data without entering an endless loop. Further, because an initial point and a terminal point of a branch that involves generation of a loop are handled as the same point N10, even if the branch that involves generation of the loop is moved, it may be necessary to move only the point N10, eliminating a necessity to perform two steps of moving the initial point and moving the terminal point.

Next, editing a branch will be described. In editing a branch, the user may activate the branch-structured vector data editing program in the embroidery data creation apparatus 1 and may enter an edit instruction by using the mouse 21 or the keyboard 22. When the branch-structured vector data editing program has been activated in the embroidery data creation apparatus 1, an edit screen that displays an image schematizing branches indicated by branch data pieces in the branch-structured vector data 300 may appear on the displays 24. For example, this image may be the embroidery result 319 shown in FIG. 5. In the embroidery result displayed on this edit screen, their branches may each be selected by operating the mouse 21 or the keyboard 22, so that the user may select a branch to be edited from the embroidery result displayed on the display 24 and may give an edit instruction.

For example, to change the sewing method, the user may select a branch and instruct a change to the sewing method. Then, a screen to select the sewing method appears, on which the user may select a different sewing method. With this, the CPU 101 of the embroidery data creation apparatus 1 may use the branch-structured vector data editing program to change a value in the sewing method information field in the branch data contained in the branch-structured vector data 300 of the specified branch to a value indicating a newly selected sewing method. To change the sewing method, a command may be entered from the keyboard 22, or a list of menus may be displayed on the display 24 by the mouse 21 or the keyboard 22, so that the user may select a desired one from among them. Alternatively, the list of menus may be displayed beforehand so that it may be selected from among them.

The following will describe the editing of the branch-structured vector data 300 in a case where a loop is generated on a branch to be connected, with reference to FIGS. 13 through 19. In the case of connecting one branch and another to each other, the user may instruct interconnection between the branches, select the branch to be connected (additional branch), select the branch to which the additional branch should be connected (connection destination branch), specify a point of the additional branch (connection point) at which it is connected to the connection destination branch, and specify a point of the connection destination branch (connection destination point) at which the additional branch is connected.

If the connection point of the additional branch is not an endpoint of the additional branch and is a point other than that on the branch, the original additional branch may be first divided at the connection point. Then, one of the resultant two branches may be used as an additional branch and an endpoint of this additional branch at which the original branch was divided may be used as a connection point. In this case, in the branch-structured vector data 300, branch data of the original additional branch may be changed into two branch data pieces. For example, an original additional branch that has a branch data number of E100, an initial point of point N100, a terminal point of point N101, and a connection point of point N109, not N100 nor N101, may be specified on the branch E100. In this example, the branch-structured vector data 300 may have branch data of the branch E100 that has the initial point N100 and the terminal point N101. This may be changed into branch data of the branch E100 that has the initial point N100 and the terminal point N109, to further create branch data of the branch E101 that has the initial point N109 and the terminal point N101. Further, a link destination of the terminal point N109 of the branch E100 may be the initial point N109 of the branch E101. Also, an additional branch may be E100 and a connection point may be the terminal point N109. The same processing may be performed in a case where a point on an connection destination branch other than an endpoint is specified to be a connection destination point.

Figure 14:
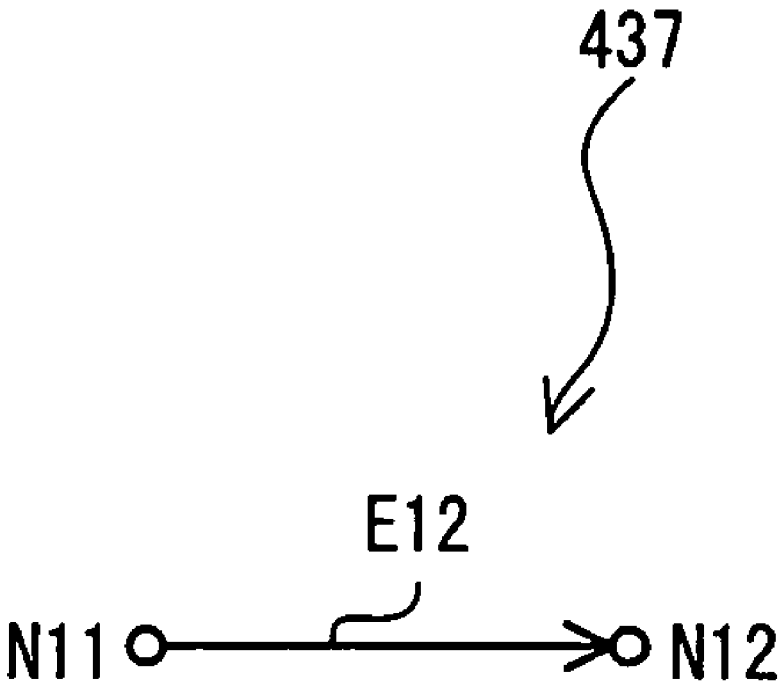
FIG. 14 is a vector diagram showing a branch involving generation of a loop.

Here, a branch E12 shown in FIG. 14 may also be connected to the branch E11 shown in FIG. 13. As shown in FIG. 14, the branch E12 may be expressed as a vector directed from an initial point N11 to a terminal point N12. The branch E12 may have the branch data as shown in a branch-structured vector data 332 shown in FIG. 16. "E12" may be stored in the branch data number field, and no information may be stored in the initial point link information field nor the terminal point link information field, "zigzag" may be stored in the sewing method information field, and "green" may be stored in the thread color information field. Further, the branch E11 shown in FIG. 13 may start at the point N10, trace a roughly circular trajectory, and return to the same point N10 as the initial point as described above. Explanation of the branch-structured vector data 331 of the branch E11 may be omitted here because it was already described as an example of the branch-structured vector data 300, which involves generation of a loop.

For example, the terminal point N12 of the branch E12 may be connected to the initial point N10 of the branch E11, an additional branch may be E12, a connection point is the terminal point N12 of the branch E12, a connection destination branch may be E11, and a connection destination point may be the initial point N10 of the branch E11. Accordingly, such a post-connection condition may be given as a vector diagram 441 shown in FIG. 17, in which the branches E11 and E12 are connected to each other at N10.

In this case, branch data of the branch E12 in branch-structured vector data 332 (see FIG. 16) may be added to the branch-structured vector data 331 (see FIG. 15). As shown in FIG. 15, in the terminal point link information field of the connection destination branch E11, "E11" itself may have been stored in the link destination branch identification information field, "initial point" may have been stored in the link destination branch endpoint information field, and "provided" may have been stored in the loop information field. In the terminal point link information field of this connection destination branch E11, "branch E12," which is the additional branch, may be stored in the link destination branch identification information field, "terminal point," which is the connection endpoint, may be stored in the link destination branch endpoint information field. And "not provided" may be stored in the loop information field. Further, as a link destination of the terminal point N12, which is the connection point of the additional branch E12, the connection destination branch "E11" may be stored in the link destination branch identification information field and "initial point," which is one of the endpoints of the connection destination branch E11 that did not indicate generation of a loop, may be stored in the link destination endpoint information field in the terminal point link information field. And, "provided" may be stored in the loop information field.

The branch-structured vector data 340 as shown in FIG. 18 may be obtained after the above branch-structured vector data is edited. As shown in FIG. 18, nothing may be stored in the initial point link information field of the branch E11, while "E12" may be stored as link destination branch identification information and "terminal point" may be stored as link destination branch endpoint information in the terminal point link information field, thus indicating that the terminal point N10 of the branch E11 may link to the terminal point N10 of the branch E12. And "not provided" may be stored in the loop information field. Further, for the branch E12, nothing may be stored in the initial point link information field, while "E11" may be stored as link destination branch identification information and "initial point" may be stored as link destination branch endpoint information in the terminal point link information field, thus indicating that the terminal point N10 of the branch E12 may link to the initial point N10 of the branch E11. And, "provided" may be stored in the loop information field, so that it is known that directly tracing the link results in a loop being generated.

The following will describe operations of creating embroidery data 443 for a green embroidery thread from the branch-structured vector data 340. Creation of this embroidery data 443 may be performed by executing the embroidery data creation program in the embroidery data creation apparatus 1. First, the branch-structured vector data 340 may be searched for a starting point of a start branch at which embroidering is to start. In this case, N10, which is the initial point of the branch E11, may be employed as the starting point.

Because the initial point N10 of the branch E11 is the starting point, first, branch data of the branch E11 may be read. Then, thread color information field may be read to determine whether it indicates "green," which is a thread color of embroidery data 443 being created currently. Because the thread color information of the branch Ellis "green," running stitch sewing data 4431 may be created, which is used to perform running stitch sewing from the initial point N10 to the terminal point N10 of the branch E11. Subsequently, information of a link destination of the terminal point N10 of the branch E11, which is an embroidery ending point of the created running stitch sewing data 4431, may be read from the terminal point link information of the branch E11. As shown in FIG. 18, the link destination of the terminal point N10 of the branch E11 may be the terminal point N10 of the branch E12. Accordingly, branch data of the branch E12 may be read.

Then, the thread color information may be referred to and determined whether to be "green," which is the thread color of the embroidery data 443 being created currently. Because the thread color information of the branch E12 is "green," running stitch sewing data 4432 may be created that is used for sewing from the terminal point N10 to the initial point N11 of the branch E12. Subsequently, information of a link destination of the initial point N11 of the branch E12, which is an embroidery ending point of the created running stitch sewing data 4432, may be read from initial point link information field of the branch E12. Because the initial point N11 of the branch E12 has no link destination, stitch sewing data 4433 may be created for sewing from the initial point N11 to the terminal point N10 of the branch E12. The sewing method employed may be a zigzag stitch.

Then, information of a link destination of the terminal point N10 of the branch E12, which is an embroidery ending point of the created stitch sewing data 4433, may be read from terminal point link information of the branch E12. Although, as shown in FIG. 18, the link destination of the terminal point N10 of the branch E12 may be the initial point N10 of the branch E11, "provided" may be stored in the loop information field, so that directly tracing the link results in a loop being generated. To avoid this, stitch sewing data may be created without tracing the initial point N10 of the link destination branch E11. Accordingly, a link source of the terminal point N10 of the branch E12 may be searched for. The link source of the terminal point N10 of the branch E12 may be the terminal point N10 of the branch E11 as shown in FIG. 18. Therefore, stitch sewing embroidery data 4434 may be created for sewing from the terminal point N10 to the initial point N10 of the branch E11.

Then, when the stitch sewing embroidery data 4434 is created for sewing from the terminal point N10 to the initial point N10 of the branch E11, it may determine whether to further create embroidery data for sewing from the initial point N10 of the branch E11, which is an embroidery ending point of the stitch sewing data 4434. However, because this point is the starting point of this embroidery data, embroidery data is no longer created.

Such processing may also enable creating the embroidery data 443 from the branch-structured vector data 340 created by connecting a branch to any other branch that involves generation of a loop, without breakdown due to generation of an endless loop or generation of such a branch that running stitch sewing data or stitch sewing data may not be created.

Figure 17:
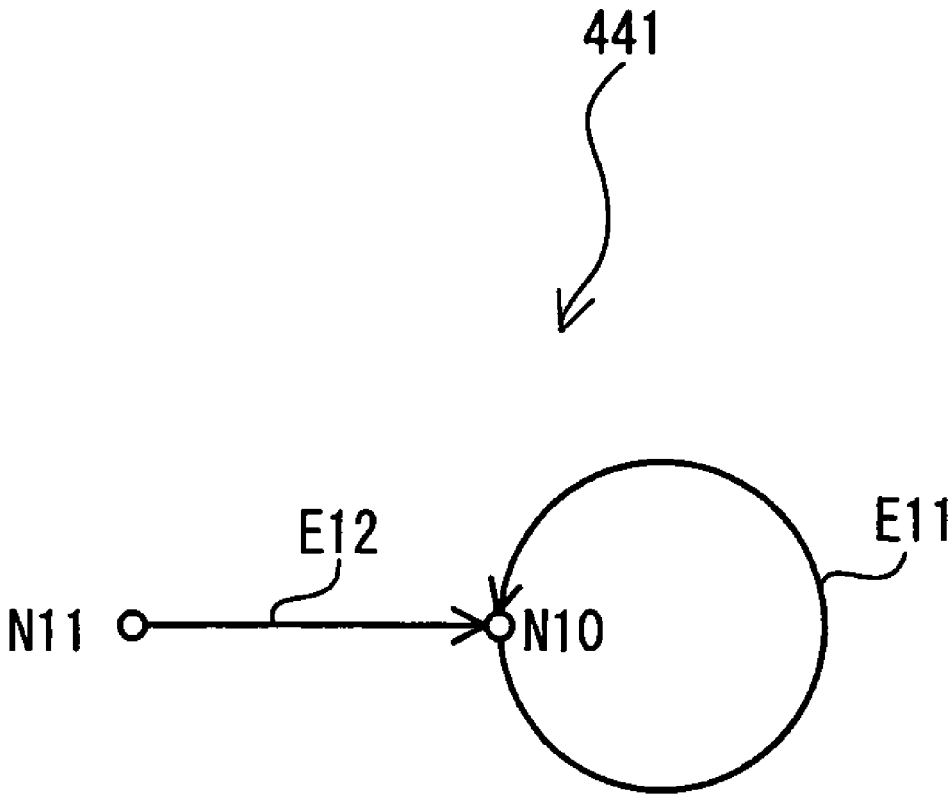
FIG. 17 is a vector diagram showing a condition after two branches are connected to each other.
Figure 20:
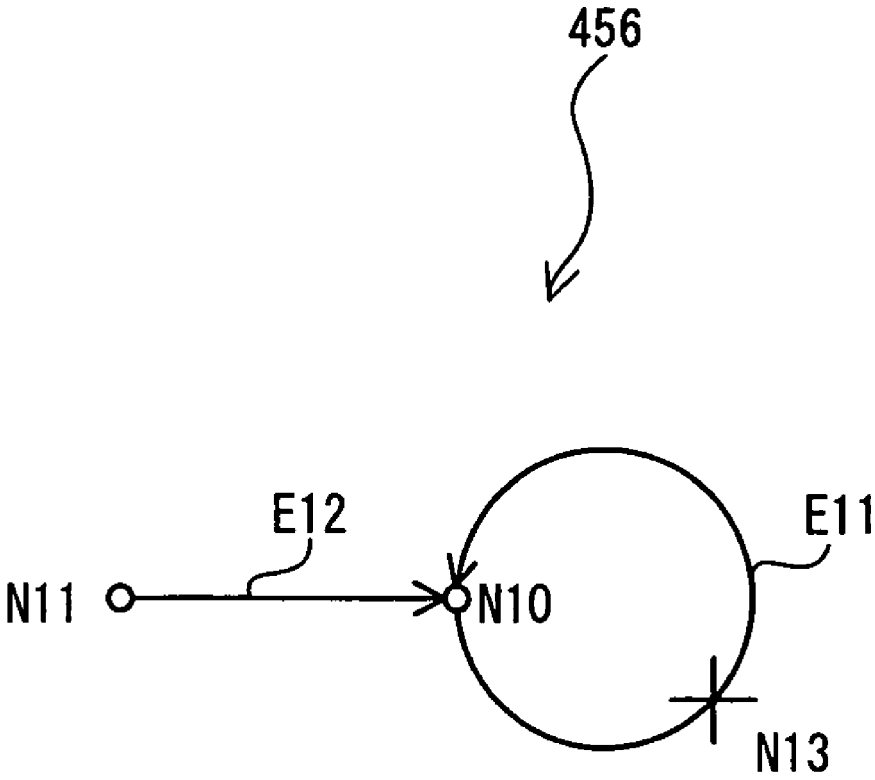
FIG. 20 is a vector diagram showing a cut-off point on a branch.

Next, editing the branch-structured vector data 300 will be described in the case of dividing a branch that involves generation of a loop, with reference to FIGS. 20 through 24. In the case of dividing a branch, the user may instruct dividing the branch and specifying a point of the branch where it may be divided. For example, the branch E11 of the branch-structured vector data 340 (see FIG. 18), which is constituted by branches E11 and E12 as shown in FIG. 17, may be divided at a point N13 as shown in FIG. 20.

Figure 21:
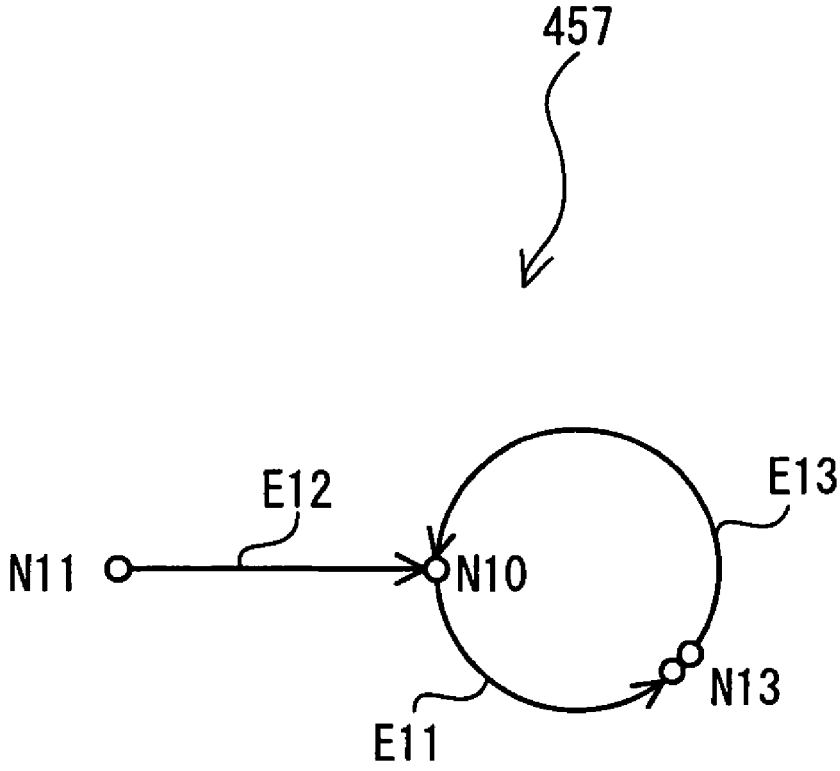
FIG. 21 is a vector diagram showing a condition after a branch is divided.
Figure 25:
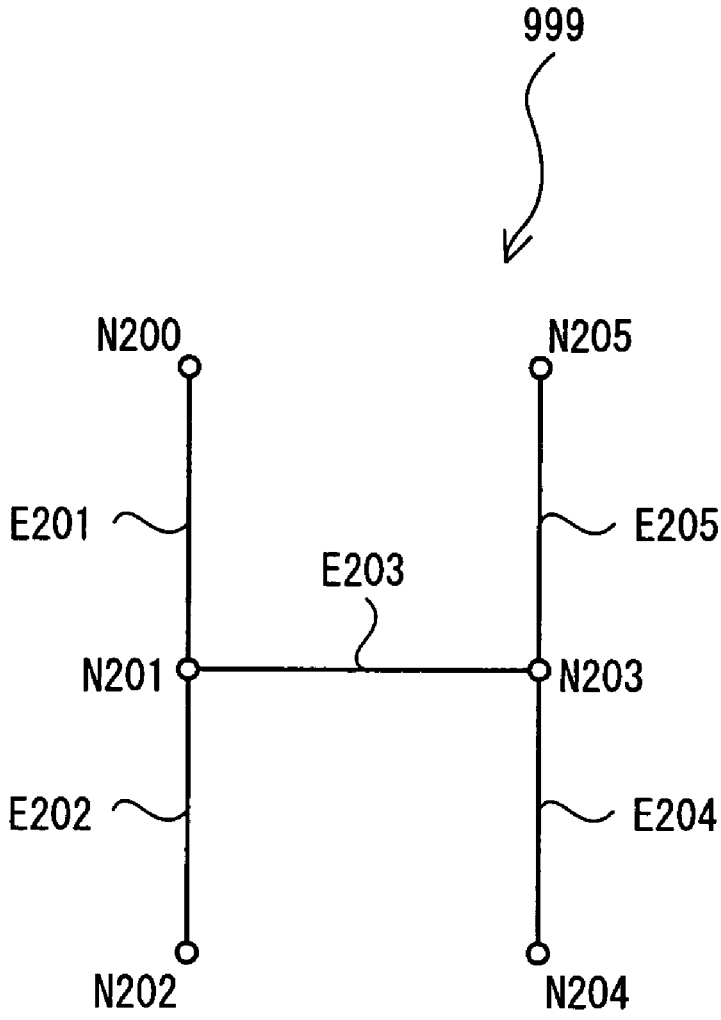
FIG. 25 is a diagram in which conventional tree structure data is schematized.
Figure 26:
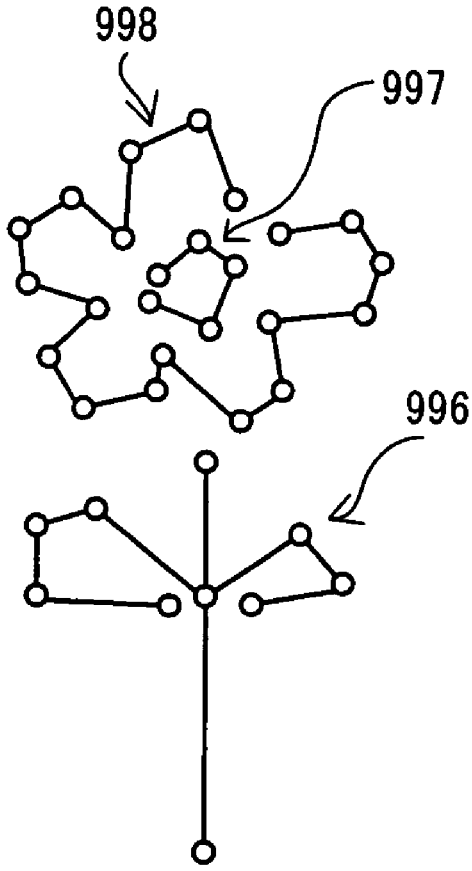
FIG. 26 is another diagram in which conventional tree structure data is schematized.

If the branch E11 is divided at the point N13, as shown in FIG. 21, the branch E11 may be divided into two branches. That is, it may be divided into two branches: a new branch E11 (first branch) that may have the initial point N10 of the original branch E11 as its initial point and the division point N13 as its terminal point; and another new branch E13 (second branch) that may have the division point N13 as its initial point and the terminal point N10 of the original branch E11 as its terminal point. Although N13 is indicated by two round marks, the N13 may be the terminal point of the branch E11 and N13, and the initial point of the branch E13 may not link to each other, so that the terminal point of the branch E11 and the initial point of the branch E13 may actually have the same coordinates.

Specifically, branch data of the branch E13 may be newly added to the branch-structured vector data 340. Accordingly, in the vector data field of the branch data of the branch Eli, its terminal point may be changed to the division point N13. And, nothing may be stored as the value of all of the terminal point link information field. On the other hand, in the vector data field of the branch data of the branch E13, its initial point may be set to the division point N13, its terminal point may be set to N10, which is the terminal point of the original branch E11. Further, as a value of the terminal point link information field, the value of the terminal point link information field of the original branch E12 may be stored.

At this point in time, such branch-structured vector data 351 may be given as shown in FIG. 22. As shown in FIG. 22, nothing may be stored in the initial point link information field of the branch data of the branch E11 similar to the initial point link information field of the branch E11 of the branch-structured vector data 340 shown in FIG. 18 and nothing may be stored in the terminal point link information field, either. Further, the information of the branch data of the branch E12 may be the same as contents of the branch E12 of the branch-structured vector data 340 shown in FIG. 18: nothing may be stored in the initial point link information field; "branch E11" may be stored in the link destination identification information field; "initial point" may be stored in the link destination endpoint information field in the terminal point link information field; and "provided" may be stored in the loop information field. As for the information of the branch data of the branch E13, nothing may be stored in the initial point link information field, while in the terminal point link information field, similar to the terminal point link information field of the branch E11 of the branch-structured vector data 340 shown in FIG. 18, "E12" may be stored in the link destination branch identification information field, the "terminal point" may be stored in the link destination branch endpoint information field, and "not provided" may be stored in the loop information field.

Next, the loop information of each of the branch data pieces may be adjusted. To do so, first a start branch is searched for. In this case, N13, which is the initial point of the branch E13, may be employed as the starting point.

The initial point link information of the branch E13 may indicate that the initial point N13 of the branch E13 has no link destination. Accordingly, if tracing the branch E13 to a link destination of the terminal point N10 of the branch E13 is based on the terminal point information, the terminal point N10 of the branch E12 may be traced as shown in FIG. 22. Then, if tracing the branch E12 to a link destination of the terminal point N10 of the branch E12 based on the terminal point side link information, the initial point N10 of the branch E11 may be obtained. The loop information of the terminal point N10 of the branch E12, however, may be "provided," so that no link destination may be traced from this point. Accordingly, when a link destination of the initial point N11 is referred to, which is the other endpoint of the branch E12 opposite to the terminal point N11, it may be shown that there is no link destination by the initial point link information of the branch E12, which means disruption of the link. That is, tracing the link from the branch E13 may not connect to the branch E11. Therefore, "provided" may not be changed to "not provided" in the loop information field in the terminal point link information field of the branch E12. After this alteration, such branch-structured vector data 352 may be given as shown in FIG. 23.

The following will describe operations of creating embroidery data 453 of a green embroidery thread from the branch-structured vector data 352. Creation of this embroidery data 453 may be performed by executing the embroidery data creation program in the embroidery data creation apparatus 1. First, the branch-structured vector data 352 may be searched for a starting point of a start branch at which embroidering is to start. In this case, N13, which is the initial point of the branch E13, may be employed as the starting point.

Because the initial point N13 of the branch E13 may be the starting point, first, branch data of the branch E13 may be read first. Then, thread color information may be referred to and determined on whether to be "green," which is a thread color of embroidery data 453 being created currently. Because the thread color information of the branch E13 is "green," running stitch sewing data 4531 may be created that is used to perform running stitch sewing from the initial point N13 to the terminal point N10 of the branch E13. Subsequently, information of a link destination of the terminal point N10 of the branch E13, which is an embroidery ending point of the created running stitch sewing data 4531, is read from the terminal point link information of the branch E13. As shown in FIG. 23, the link destination of the terminal point N10 of the branch E13 may be the terminal point N10 of the branch E12. Accordingly, branch data of the branch E12 may be read.

Then, thread color information field may be read to determine whether it indicates "green," which is a thread color of embroidery data 453 being created currently. Because the thread color information field of the branch E12 is "green," running stitch sewing data 4532 may be created for sewing from the terminal point N10 to the initial point N11 of the branch E12. Subsequently, information of a link destination of the initial point N11 of the branch E12, which is an embroidery ending point of the created running stitch sewing data 4532, may be read from initial point link information field of the branch E12. Because the initial point N11 of the branch E12 has no link destination, stitch sewing data 4533 may be created for sewing from the initial point N11 to the terminal point N10 of the branch E12. The sewing method employed may be zigzag stitch.

Then, information of a link destination of the terminal point N10 of the branch E12, which is an embroidery ending point of the running stitch sewing data 4533, may be read from terminal point link information of the branch E12. As shown in FIG. 23, a link destination of the terminal point N10 of the branch E12 may be the initial point N10 of the branch E11. In this case, because the loop information has been changed to "not provided," the link destination may be traced. Therefore, running stitch sewing data 4534 may be created for sewing from the initial point N10 to the terminal point N13 of the link destination branch E11.

Then, information of a link destination of the terminal point N13 of the branch E11 may be read from terminal point link information field of the branch E11. As shown in FIG. 23, the terminal point N13 of the branch E11 may have no link destination. Accordingly, stitch sewing data 4535 may be created for sewing from the terminal point N13 to the initial point N10 of the branch E11. Then, a link source of the initial point N10 of the branch E11 may be searched for. Although, as shown in FIG. 23, the link source of the initial point N10 of the branch E11 may be the terminal point N10 of the branch E12, the stitch sewing data 4533 for the branch E12 may be already created, a link source of the terminal point N10 of the branch E12 may be further searched for. The link source of the terminal point N10 of the branch E12 may be the terminal point N10 of the branch E13 as shown in FIG. 23. Because stitch sewing data for the branch E13 has not been created, stitch sewing data 4536 may be created for sewing from the terminal point N10 to the initial point N13 of the branch E13.

When the stitch sewing data 4536 is created for sewing from the terminal point N10 to the initial point N13 of the branch E13, it may determine to further create embroidery data for sewing from the initial point N13 of the branch E13, which is an embroidery ending point of the stitch sewing data 4536. Because this point is the starting point of this embroidery data, embroidery data may no longer be created. This processing may prevent even the branch-structured vector data 352 that a branch involving generation of a loop has been divided from causing link disconnection or disruption due to generation of an endless loop. It may be further possible to create the complete embroidery data 453 without generating a branch having no running stitch sewing data or stitch sewing data.

As described above, it may be possible to represent branches having different thread colors by the one piece of branch-structured vector data 300 and a branch that involves generation of a loop by the same branch-structured vector data 300. Therefore, when editing for a gathered group of branches represented by the branch-structured vector data 300 and moving, shrinking, or expanding them, it may be possible to process the branches having different thread colors, including branches that involve generation of a loop, simultaneously.

The data structure of a branch-structured vector data may include at least one piece of branch data. The at least one piece of branch data may include at least identification information that identifies a branch, which is a path of embroidery connecting two endpoints; vector data that indicates a direction of the branch by a position of an initial point, which is one of the endpoints of the branch, and a position of a terminal point, which is the other of the endpoints; link information that relates to a link destination branch, which is another branch linking to the endpoint; sewing method information that indicates a method for sewing the branch as embroider; and thread color information that indicates a color of a sewing thread to be used when the branch is embroidered. Therefore, one piece of branch-structured vector data may include information of branches having a plurality of thread colors, thereby eliminating a necessity of having branch-structured vector data for each of the thread colors. This may prevent the data from becoming complicated. When editing branch-structured vector data in accordance with a user's instruction, it may be possible to easily gather up branches having different thread colors and edit them.

Further, the data structure of a branch-structured vector data may include at least one piece of branch data. The at least one piece of branch data may include at least identification information that identifies a branch, which is a path of embroidery connecting two endpoints; the at least one piece of branch data may include vector data that indicates a direction of the branch by a position of an initial point, which is one of the endpoints of the branch, and a position of a terminal point, which is the other of the endpoints; link information that relates to a link destination branch, which is another branch linking to the endpoint; sewing method information that indicates a method for sewing embroidery of the branch; and loop information that indicates whether tracing a link destination branch of the endpoint results in generation of a loop that returns to the same endpoint. Accordingly, it may be possible to represent such a loop that embroidery starting from a point returns to this same point, by using loop information, thereby representing a branch that forms a loop and a branch that does not form a loop, by using the same branch-structured vector data. Therefore, because it is possible to determine whether a branch forms a loop by the loop information, branch data may be processed in such a manner as not to make an endless loop when tracing the link destination of an endpoint of a branch. Therefore, it may only be necessary to edit one piece of branch-structured vector data when editing a branch that forms a loop and a branch that does not form a loop, thus facilitating processing for the editing.

In the branch-structured vector data structure, branch data may include thread color information that indicates a color of a sewing thread used for embroidering a branch, which thread information may be used to determine whether to create embroidery data of a branch specified in link information. Therefore, one piece of branch-structured vector data may have information of a plurality of thread colors and even represent a loop and so will not be complicated. Further, it may be unnecessary to have branch-structured vector data for each thread color, so that when editing branch-structured vector data in accordance with a user's instruction, branches of different thread colors may be easily gathered up and edited at a time. Also, loop information may be used to represent such a loop that embroidery starting at a point may come back to the same point, so that it thus possible to represent a branch that forms a loop and a branch that does not form a loop, by using the same branch-structured vector data. Therefore, when editing branch-structured vector data in accordance with a user's instruction, it may be possible to easily gather up and edit branches, which have different thread colors or form a loop at a time.

Further, in the branch-structured vector data structure, link information may include link destination branch information that identifies a link destination branch and link destination branch endpoint information, which indicates an endpoint of a link destination branch to be linked, for each of the two endpoints. Therefore, for each of the two endpoints, a link destination branch may be identified by the link destination branch identification information and which one of the endpoints of the link destination branch is connected to may also be identified by the link destination branch endpoint information. Accordingly, it may be possible to represent at which ones of their endpoints that the branches are connected and linked to each other, so that when creating embroidery data, it may be possible to determine not only embroidery data of which one of the branches is to be created but also from which one of the endpoints of the branch the embroidery is to go to the other endpoint.

In the branch-structured vector data editing apparatus, the branch-structured vector data storage device may store branch-structured vector data of a data structure including at least one piece of branch data. The at least one piece of branch data may include identification information that identifies a branch, which is a path of embroidery connecting two endpoints; vector data that indicates a direction of the branch by a position of an initial point, which is one of the endpoints of the branch, and a position of a terminal point, which is the other of the endpoints; link information that relates to a link destination branch, which is another branch linking to the endpoint; sewing method information that indicates a method for sewing when the branch is embroidered; and thread color information that indicates a color of a sewing thread to be used when the branch is embroidered. In addition, the edit instruction device may instruct an operation of editing a branch that represents an embroidery result and the branch-structured vector data editing device may edit branch-structured vector data stored in the branch-structured vector data storage device in accordance with an instruction of the edit instruction device. That is, a plurality of branch-structured vector data pieces may not exist for each color. Instead, one branch-structured vector data piece may be constituted by branch data pieces for embroidery having a plurality of colors. Therefore, when editing branches having different colors, it may be unnecessary to edit a plurality of branch-structured vector data pieces for each of the colors and only one of the branch-structured vector data pieces needs to be edited, thereby simplifying a processing step that is performed for editing. Furthermore, management of branch-structured vector data may be less troublesome than in a case where a plurality of branch-structured vector data pieces exists for each color. Moreover, the user, who instructs the editing, does not need know about a color of embroidery in instruction of edition.

Further, in the branch-structured vector data editing apparatus, the branch-structured vector data storage device may store branch-structured vector data of a data structure including at least one piece of branch data. The at least one piece of branch data may include identification information that identifies a branch, which is a path of embroidery connecting two endpoints; vector data that indicates a direction of the branch by a position of an initial point, which is one of the endpoints of the branch, and a position of a terminal point, which is the other of the endpoints; link information that relates to a link destination branch, which is another branch linking to the endpoint; sewing method information that indicates a method for sewing when the branch is embroidered; and loop information that indicates whether tracing a link destination branch of the endpoint results in generation of a loop that returns to the same endpoint. In addition, the edit instruction device may instruct an operation of editing a branch that represents an embroidery result and the branch-structured vector data editing device may edit branch-structured vector data stored in the branch-structured vector data storage device in accordance with an instruction of the edit instruction device. By providing loop information, it may be possible to represent such a loop that embroidery starting from a point returns to the same point. That is, it may be possible to constitute branch data of a branch that forms a loop and a branch that does not form a loop, by using one branch-structured vector data piece. Because it is possible to determine whether a branch forms a loop by the loop information, branch data may be processed in such a manner as not to make an endless loop when tracing the link destination of an endpoint of a branch. Therefore, it may only be necessary to edit one piece of branch-structured vector data when editing a branch which forms a loop and a branch which does not form a loop, thus facilitating processing for the editing. Moreover, the user, who instructs the editing, may instruct to do so without knowing about a branch that forms a loop and a branch that does not form a loop.

In the branch-structured vector data editing apparatus, the branch data in the branch-structured vector data that may be stored in the branch-structured vector data storage device may have thread color information, which indicates a color of a sewing thread that is used when embroidering a branch. Accordingly, it may be possible to edit the branch-structured vector data that has the thread color information and represents such a loop that embroidery starting at a point may come back to the same point. Therefore, when editing the branch-structured vector data in accordance with a user's instruction, branches having different thread colors may be easily gathered up and edited at a time. Furthermore, the branches that have different thread colors or form a loop may be easily gathered up and edited at a time. Moreover, the user, who instructs the editing, may instruct to do so without knowing about an embroidery color or which branch forms a loop and which branch does not.

Further, in the branch-structured vector data editing apparatus, a color specification device in the edit instruction device may specify a color of a thread to be used in embroidery of a branch. Further, a thread color information alteration device in the vector data editing device may change the color indicated by the thread color information to the color specified by the color specification device. With this, if a color of a thread is specified by the color specification device, link information may not be changed. Therefore, to change a thread color of a branch, only the thread color information needs to be changed, thus a necessity of changing a relationship of connections between branches may be eliminated and the processing may be prevented from becoming complicated.

In the branch-structured vector data editing apparatus, in the edit instruction device, a division branch specification device may specify a division branch to be divided and a division point specification device may specify a division point of a division branch specified by the division branch specification device. Further, a division device in the vector data editing device may divide branch data of a division branch into branch data of a first branch that has an initial point of a division branch and a division point as its initial point and terminal point, respectively, and branch data of a second branch that has the division point and a terminal point of the division branch as its initial point and terminal point, respectively. Accordingly, in a case where the loop information of a division branch indicates generation of a loop, a first loop information control device may make all of the loop information pieces of endpoints in the branch data of the first and second branches to indicate no generation of a loop. It thus may be possible to divide a loop-shaped branch without disrupting connection of the branch or making an endless loop.

Further, in the branch-structured vector data editing apparatus, in the edit instruction device, an additional branch specification device may specify an additional branch to be added to vector data and a connection destination branch specification device may specify a connection destination branch to which an additional branch specified by the additional branch specification device is to be connected. Further, if the loop information of the connection destination branch indicates generation of a loop, a loop connection device in the vector data editing device may provide an additional endpoint that is an endpoint on the side to which the additional branch is to be connected as a link destination endpoint of a loop endpoint, which is an endpoint on the side that has the loop information indicating generation of the loop, and provide an endpoint that is not on the side of the loop endpoint as a link destination endpoint of the additional endpoint. On the other hand, a second loop information control device may make the loop information of the loop endpoint to indicate no loop generation and the loop information of the additional endpoint to indicate loop generation. It may thus be possible to add even a new branch to a loop-shaped branch without disrupting connection of the branch or entering an endless loop.

In the branch-structured vector data editing apparatus of the present disclosure, the embroidery data creation device may create embroidery data that indicates strokes of a needle of an embroidery sewing machine, based on branch-structured vector data according to the exemplary embodiments of the present disclosure. A running stitch sewing data creation device in the embroidery data creation apparatus may create running stitch sewing data, which is embroidery data indicating that running stitch sewing is to be performed between an initial point and a terminal point that are indicated by vector data. Further, the color determination device may determine whether the color indicated by the thread color information of the link destination branch indicated by the link information is the same as the current thread color, which is a thread color of the currently created embroidery data. Further, the running stitch sewing data creation control device may trace the link destination branch indicated by the endpoint on the sewing termination side of running stitch sewing data until the color indicated by the thread color information of the link destination branch may be determined to be the same as the current thread color and cause the running stitch sewing data creation device to create the running stitch sewing data of the link destination branch determined to be the same as the current thread color. It thus may be possible to create running stitch sewing data for a branch, which is to undergo running stitch sewing, by using each of colors from branch-structured vector data constituted of branch data pieces for a plurality of thread colors.

Further, in the embroidery data creation apparatus, in the embroidery data creation device, the stitch sewing data creation device may create stitch sewing data, which is embroidery data indicating that stitch sewing is to be performed over where running stitch sewing has been performed, in accordance with the sewing method specified by the sewing method information. If the link information of the endpoint, which corresponds to the sewing termination side of the running stitch sewing data created by the running stitch sewing data creation device, does not indicate any link destination branch, the sewing method alteration control device may cause the stitch sewing data creation device to create the stitch sewing data for sewing from the endpoint that corresponds to the sewing termination side to the other endpoint. Therefore, by performing alteration from creation of running stitch sewing data to creation of stitch sewing data, the running stitch sewing data and stitch sewing data may be created without the embroidery being interrupted or entering an endless loop.

In the embroidery data creation apparatus, a link source search device in the embroidery data creation device may search for former link information, which is link information that specifies as a link destination an endpoint corresponding to the sewing termination side of the stitch sewing data. In addition, a stitch sewing data creation control device may trace the former link information from the endpoint on the sewing termination side of the stitch sewing data until a color indicated by the thread color information of the branch data having the former link information is determined by the color determination device to be the same as the current thread color and cause the stitch sewing data creation device to create the stitch sewing data for sewing the branch having the former link information determined to be of the same as the current thread color from the endpoint that indicates the former link information to the other endpoint. It thus may be possible to create stitch sewing data for a branch to be sewn using each of colors, from branch-structured vector data constituted of branch data pieces of a plurality of thread colors.

Further, in the embroidery data creation apparatus, the embroidery data creation device may create embroidery data that indicates strokes of a needle of an embroidery sewing machine, based on branch-structured vector data according to exemplary embodiments. In addition, the running stitch sewing data creation device in the embroidery data creation device may create running stitch sewing data, which is embroidery data indicating that running stitch sewing is to be performed between an initial point and a terminal point which are indicated by vector data, and the stitch sewing data creation device may create stitch sewing data, which is embroidery data that indicates that finish sewing is to be performed over where running stitch sewing has been performed, in accordance with the sewing method specified in the sewing method information. Further, if the loop information of the endpoint on the sewing termination side of the running stitch sewing data or the stitch sewing data indicates generation of a loop, the turn-back control device may not cause the running stitch sewing data creation device to create running stitch sewing data of a link destination branch of the endpoint. Instead, it may cause the stitch sewing data creation device to create stitch sewing data of finish sewing from the endpoint on the sewing termination side to the other endpoint of the running stitch sewing data. Therefore, from the branch-structured vector data that may represent such a loop that embroidery starting at a point may come back to the same point, running stitch sewing data and stitch sewing data may be created so that the embroidery is not interrupted or enters an endless loop.

In the branch-structured vector data editing program, the instructions for displaying may display a schematic diagram of an embroidery result represented by branch-structured vector data having a data structure including at least one branch data piece. The at least branch data piece may include at least identification information that identifies a branch, which is a path of embroidery connecting two endpoints; vector data that indicates a direction of the branch by a position of an initial point, which is one of the endpoints of the branch, and a position of a terminal point, which is the other of the endpoints; link information that relates to a link destination branch, which is another branch which links to the endpoint; sewing method information that indicates a method for sewing the branch as embroidery; and thread color information that indicates a color of a sewing thread which is used when embroidering the branch. Then, in the instructions for issuing an editing instruction and in the instructions for editing, the branch-structured vector data may be edited in accordance with the instruction made in the instructions for issuing the edit instruction. That is, a plurality of branch-structured vector data pieces may not exist for each color. Instead, one branch-structured vector data piece may be constituted by branch data of embroidery having a plurality of colors. Therefore, when editing branches having different colors, it may be unnecessary to edit a plurality of branch-structured vector data pieces for each of the colors and only one branch-structured vector data needs to be edited, thereby enabling simplifying a processing step that is performed in the editing. Furthermore, management of branch-structured vector data may be less troublesome than in a case where a plurality of branch-structured vector data pieces exist for each color. Moreover, the user, who instructs the editing of the branch-structured vector data, does not need know about a color of embroidery in the instructions for issuing an edit instruction.

Further, in the branch-structured vector data editing program, the instructions for displaying may display a schematic diagram of an embroidery result represented by branch-structured vector data having a data structure including at least one branch data piece. The at least one branch data piece may include at least identification information that identifies a branch, which is a path of embroidery connecting two endpoints; vector data that indicates a direction of the branch by a position of an initial point, which is one of the endpoints of the branch, and a position of a terminal point, which is the other of the endpoints; link information that relates to a link destination branch, which is another branch which links to the endpoint; sewing method information that indicates a method for sewing the branch as embroidery; and loop information that indicates whether tracing a link destination of the endpoint results in generation of a loop that returns to the same endpoint. Then, in the instructions for issuing an edit instruction, the editing of a branch that represents the embroidery result may be instructed and in the instructions for editing, the branch-structured vector data may be edited in accordance with an instruction made in the instructions for issuing an editing instruction. Therefore, by providing loop information, it may be possible to represent a loop that embroidery starting from a point returns to the same point. That is, it may be possible to constitute branch data of a branch that forms a loop and a branch that does not form a loop by one branch-structured vector data piece. As it may be possible to determine whether a branch forms a loop by the loop information, branch data may be processed in such a manner as not to make an endless loop when tracing the link destination of an endpoint of a branch. Therefore, it may only be necessary to edit one piece of branch-structured vector data when editing a branch that forms a loop and a branch that does not form a loop, and thus may facilitate processing for the editing. Moreover, the user, who instructs the editing of the branch-structured vector data, may instruct to do so without knowing about a branch, which forms a loop, and a branch, which does not form a loop.

In the branch-structured vector data editing program of the present disclosure, branch data in branch-structured vector data may have thread color information that indicates a color of a sewing thread, which is used when embroidering a branch. Accordingly, it may be possible to edit branch-structured vector data that has the thread color information and that may represent such a loop that embroidery starting at a point that may come back to the same point. Therefore, when editing the branch-structured vector data in accordance with a user's instruction, branches having different thread colors may be easily gathered up and edited at a time. Furthermore, such branches that have different thread colors or form a loop may be easily gathered up and edited at a time. Moreover, the user, who instructs the editing, may instruct to do so without knowing about an embroidery color or which branch forms loop and which branch does not.

Further, in the branch-structured vector data editing program of the present disclosure, in the instructions for specifying the color included in the instructions for editing, the color of the thread to be used in embroidery of the branch may be specified. Further, in the instructions for changing the color indicated by the thread color information included in the instructions for editing, the color indicated in the thread color information may be changed to the color specified in the instructions for specifying. With this, if a color of the thread is specified by the instructions for specifying, the link information may not be changed. Therefore, to change a thread color of a branch, only the thread color information may only need to be changed, and thus eliminates a necessity of changing a relationship of connections between branches. Thereby, the processing may be prevented from becoming complicated.

In the branch-structured vector data editing program, in instructions for specifying a division branch included in the instructions for issuing the edit instruction, a division branch to be divided may be specified and in instructions for specifying a division point, a division point of a division branch specified by the division branch specification device may be specified. Further, in instructions for dividing the branch data included in the instructions for editing, the branch data of the division branch may be divided into branch data of a first branch that has an initial point of the division branch and the division point as its initial point and terminal point, respectively, and branch data of a second branch that has the division point and a terminal point of the division branch as its initial point and terminal point, respectively. Accordingly, in a case where loop information of the division branch indicates generation of a loop, in instructions for making all of the loop information pieces, all of loop information pieces of endpoints in the branch data of the first and second branches may be made to indicate no generation of a loop. It thus may be possible to divide a loop-shaped branch without disrupting connection of the branch or making an endless loop.

Further, in the branch-structured vector data editing program, in instructions for specifying an additional branch included in the instructions for issuing the edit instruction, an additional branch to be added to vector data may be specified. And in instructions for specifying a connection destination branch, a connection destination branch to which the additional branch specified by the instructions for specifying the additional branch is to be connected may be specified. Further, if the loop information of a connection destination branch indicates generation of a loop, instructions for providing an additional endpoint included in the instructions for editing may provide an additional endpoint that is an endpoint on the side to which the additional branch is to be connected, as a link destination endpoint of a loop endpoint, which is an endpoint on the side that has the loop information indicating generation of the loop, and provide an endpoint that is not on the side of the loop endpoint as a link destination endpoint of the additional endpoint. In addition, instructions for making loop information may make the loop information of the loop endpoint to indicate no loop generation and make the loop information of the additional endpoint to indicate loop generation. It is thus possible to add a new branch to a loop-shaped branch without disrupting connection of the branch or entering an endless loop.

In the branch-structured vector data editing program, the instructions for creating the embroidery data may create embroidery data that indicates strokes of a needle of an embroidery sewing machine, based on branch structure vector data of the exemplary embodiments of the present invention. And in instructions for creating running stitch sewing data included in the instructions for creating embroidery data, embroidery data may be created, which is embroidery data indicating that running stitch sewing is to be performed between an initial point and a terminal point, which are indicated by vector data. Further, in the instructions for determining, a color indicated by the thread color information of the link destination branch indicated by the link information may be determined whether it is the same as the current thread color, which is a thread color of the currently created embroidery data. Further, in the instructions for tracing a link destination branch indicated by the endpoint on the sewing termination side of running stitch sewing data may be traced until the color indicated by the thread color information of the link destination branch is determined to be the same as the current thread color. The control may be conducted so as to create in the instructions for tracing, the running stitch sewing data of the link destination branch the same as the current thread color. It thus may be possible to create running stitch sewing data for a branch that is to undergo running stitch sewing by using each of colors, from branch-structured vector data including branch data pieces for a plurality of thread colors.

Further, in the embroidery data creation program, in instructions for creating stitch sewing data, included in the instructions for creating the embroidery data, stitch sewing data may be created, which is embroidery data indicating that stitch sewing is to be performed over where running stitch sewing has been performed, in accordance with the sewing method specified in the sewing method information. If the link information of an endpoint, which corresponds to the sewing termination side of the running stitch sewing data created in the instructions for creating running stitch sewing data, does not indicate any link destination branch, in the instructions for creating stitch sewing data for sewing, such control may be conducted as to create stitch sewing data for sewing from the endpoint that corresponds to the sewing termination side to the other endpoint in the instructions for the stitch sewing data. Therefore, by performing alteration from creation of running stitch sewing data to creation of stitch sewing data, such running stitch sewing data and stitch sewing data may be created that embroidery may not be interrupted nor enter an endless loop.

In the embroidery data creation program, in instructions for searching for former information included in the instructions for creating the embroidery data, former link information may be searched for, which is the link information that specifies as the link destination an endpoint that corresponds to the sewing termination side of stitch sewing data. In addition, in instructions for tracing the former link information, the former link information may be traced from the endpoint on the sewing termination side of the stitch sewing data until a color indicated by the thread color information of the branch data having the former link information is determined to be the same as the current thread color in the instructions for determining. Such controls may be conducted to create in the instructions for creating the stitch sewing data, stitch sewing data that causes a branch having the former link information determined to be of the same as the current thread color to be sewn from the endpoint that indicates the former link information to the other endpoint. It thus may be possible to create stitch sewing data for a branch to be sewn using each of colors, from branch-structured vector data constituted of branch data pieces of a plurality of thread colors.

Further, in the embroidery data creation program, in the instructions for creating the embroidery data, embroidery data that indicates strokes of a needle of an embroidery sewing machine may be created, based on branch-structured vector data of the exemplary embodiments of the present disclosure. In addition, in instructions for creating running stitch sewing data included in the instructions for creating the embroidery data, running stitch sewing data may be created, which is embroidery data indicating that running stitch sewing is to be performed between an initial point and a terminal point that are indicated by vector data, and in instructions for creating stitch sewing data, stitch sewing data may be created, which is embroidery data indicating that stitch sewing is performed over where running stitch sewing has been performed, in accordance with the sewing method specified in sewing method information. Further, if the loop information of the endpoint on the sewing termination side of the running stitch sewing data or the stitch sewing data indicates generation of a loop, in the instructions for conducting such control, creation of the running stitch sewing data of the link destination branch of the endpoint may be avoided in the instructions for creating the running stitch sewing data, but instead, the stitch sewing data of stitch sewing from the endpoint on the sewing termination side to the other endpoint of the running stitch sewing data may be created in the instructions for creating stitch sewing data. Therefore, from branch-structured vector data that may represent such a loop that embroidery starting at a point may come back to the same point, such running stitch sewing data and stitch sewing data may be created that embroidery may not be interrupted or enter an endless loop.

It should be noted, the present disclosure is not limited to the above exemplary embodiments and may be changed variously without departing from the scope of the present disclosure.

For example, in the exemplary embodiments, the branch-structured vector data 300 may include both loop information and thread color information so that even branches having different thread colors or involving generation of a loop might be represented by only piece of branch-structured vector data 300. However, branch-structured vector data may include the loop information only, and not the thread color information, so that a branch involving generation of a loop and a branch not involving generation of a loop may only be represented by the same branch-structured vector data, and branches with different thread colors may be represented by different branch-structured vector data pieces. Further, branch-structured vector data may include the thread color information only, and not the loop information, so that branches with different thread colors may only be represented by the same branch-structured vector data and a branch indicating generation of a loop may not be represented.

Further, although the branch-structured vector data 320 uses "green" and "red" as thread colors, the thread colors are not limited to these colors. A variety of colors, such as "pink," "black," "white," "blue," "light blue," "yellow," and "brown," may be used. Further, although a "zigzag" stitch is used as the sewing method, it is not limited to a zigzag stitch. A variety of sewing methods, known or later-developed, such as decorative stitch and straight stitch, using various stitch lengths, may be used.

Further, although the branch-structured vector data editing program and the embroidery data creation program have been recorded in the CD-ROM 114, a usable recording medium is not limited to a CD-ROM and may be any other known recording medium, such as a flexible disk or a DVD, or later developed recording medium. Further, these programs may be recorded in different recording media.

What is claimed is:

1. An embroidery data creation apparatus comprising:

an embroidery data creation device that creates embroidery data indicating strokes of a needle of an embroidery sewing machine based on branch-structured vector data, data structure of the branch-structured vector data stored on a non-transitory computer-readable recording medium being created from line drawing information of an embroidery design and used by a computer to create the embroidery data, the data structure comprising:

at least one branch data piece, the at least one branch data piece including:

identification information that identifies a branch and that is used to specify the branch, the branch being a path of embroidery connecting two endpoints, the two endpoints including a first endpoint and a second endpoint;

sewing method information that indicates a method for sewing the branch as embroidery;

vector data that indicates a direction of the branch by positions of the first endpoint as an initial point and the second endpoint as a terminal point, and that specifies a sewing position when creating running stitch sewing data and stitch sewing data, the running stitch sewing data being the embroidery data indicating running stitch sewing to be performed, and stitch sewing data being the embroidery data indicating stitch sewing to be performed over a path of the running stitch sewing in accordance with the sewing method indicated by the sewing method information;

link information that is information about a link destination branch and that specifies the link destination branch for which the embroidery data is to be created next, the link destination branch being a second branch linking to one of the endpoints; and thread color information that indicates a color of a sewing thread to be used when the branch is embroidered and that is used by the computer to determine whether to create the embroidery data of the link destination branch specified by the link information, the embroidery data creation device including:

a running stitch sewing data creation device that creates the running stitch sewing data, which is the embroidery data indicating that the running stitch sewing is to be performed between the initial point and the terminal point that are indicated by the vector data;

a color determination device that determines whether the color indicated by the thread color information of the link destination branch indicated by the link information of the one of the endpoints on a sewing termination side of the running stitch sewing data is the same as a current thread color indicated by the embroidery data; and a running stitch sewing data creation control device that traces from the one of the endpoints on the sewing termination side of the running stitch sewing data to the link destination branch until the color indicated by the thread color information of the link destination branch is determined by the color determination device to be the same as the current thread color and causes the running stitch sewing data creation device to create the running stitch sewing data of the link destination branch determined to be the same as the current thread color.

2. The embroidery data creation apparatus according to claim 1, wherein the embroidery data creation device further includes:

a stitch sewing data creation device that creates the stitch sewing data, which is the embroidery data indicating that the stitch sewing is to be performed over the running stitch sewing, in accordance with the sewing method indicated by the sewing method information; and a sewing method alteration control device that, when the link information of the one of the endpoints on the sewing termination side of the running stitch sewing data created by the running stitch sewing data creation device does not indicate a link destination branch, causes the stitch sewing data creation device to create stitch sewing data for sewing from the one of the endpoints on the sewing termination side to the other of the endpoints.

3. The embroidery data creation apparatus according to claim 1, wherein the embroidery data creation device further includes:

a link source search device that searches for former link information, which is the link information that specifies the one of the endpoints on the sewing termination side of the stitch sewing data as the link destination; and a stitch sewing data creation control device that traces the former link information from the one of the endpoints on the sewing termination side of the stitch sewing data until the color indicated by the thread color information of the branch data having the former link information is determined by the color determination device to be the same as the current thread color and causes the stitch sewing data creation device to create the stitch sewing data for sewing the branch having the former link information determined to be the same as the current thread color from the endpoint that indicates the former link information to the other endpoint.

4. An embroidery data creation apparatus comprising:

an embroidery data creation device that creates embroidery data indicating strokes of a needle of an embroidery sewing machine based on branch-structured vector data, data structure of the branch-structured vector data stored on a non-transitory computer-readable recording medium being created from line drawing information of an embroidery design and used by a computer to create the embroidery data, the data structure comprising:

at least one branch data piece, the at least one branch data piece including:

identification information that identifies a branch and that is used to specify the branch, the branch being a path of embroidery connecting two endpoints, the two endpoints including a first endpoint and a second endpoint;

sewing method information that indicates a method for sewing the branch as embroidery;

vector data that indicates a direction of the branch by positions of the first endpoint as an initial point and the second endpoint as a terminal point, and specifies a sewing position when creating running stitch sewing data and stitch sewing data, the running stitch sewing data being the embroidery data indicating running stitch sewing to be performed, and stitch sewing data being the embroidery data indicating stitch sewing to be performed over a path of the running stitch sewing in accordance with the sewing method indicated by the sewing method information;

link information that is information about a link destination branch, and specifies the branch for which the embroidery data is to be created next, the link destination branch being a second branch linking to one of the endpoints; and loop information that indicates whether tracing the link destination branch of the one of the endpoints results in generation of a loop that returns to the one of the endpoints, and that is used by the computer to determine whether to create the running stitch data of the link destination branch specified by the link information the embroidery data creation device including:

a running stitch sewing data creation device that creates the running stitch sewing data, which is the embroidery data that indicates the running stitch sewing is to be performed between the initial point and the terminal point, which are indicated by the vector data;

a stitch sewing data creation device that creates the stitch sewing data, which is the embroidery data that indicates the stitch sewing to be performed over where the running stitch sewing has been performed, in accordance with the sewing method indicated by the sewing method information; and a turn-back control device that, when the loop information of one of the endpoints on a sewing termination side of the running stitch sewing data or the stitch sewing data indicates generation of the loop, does not cause the running stitch sewing data creation device to create the running stitch sewing data of the link destination branch of the one of the endpoints on the sewing termination side of the running stitch sewing data, but causes the stitch sewing data creation device to create stitch sewing data from the endpoint on the sewing termination side to the other endpoint of the running stitch sewing data.

5. An embroidery data creation program recorded on a non-transitory computer-readable recording medium and executable by a computer, the program comprising:

instructions for creating embroidery data indicating strokes of a needle of an embroidery sewing machine based on branch-structured vector data, data structure of the branch-structured vector data stored on the non-transitory computer-readable recording medium being created from line drawing information of an embroidery design and used by the computer to create the embroidery data, the data structure comprising:

at least one branch data piece, the at least one branch data piece including:

identification information that identifies a branch and that is used to specify the branch, the branch being a path of embroidery connecting two endpoints, the two endpoints including a first endpoint and a second endpoint;

sewing method information that indicates a method for sewing the branch as embroidery;

vector data that indicates a direction of the branch by positions of the first endpoint as an initial point and the second endpoint as a terminal point, and that specifies a sewing position when creating running stitch sewing data and stitch sewing data, the running stitch sewing data being the embroidery data indicating running stitch sewing to be performed, and stitch sewing data being the embroidery data indicating stitch sewing to be performed over a path of the running stitch sewing in accordance with the sewing method indicated by the sewing method information;

link information that is information about a link destination branch and that specifies the link destination branch for which the embroidery data is to be created next, the link destination branch being a second branch linking to one of the endpoints; and thread color information that indicates a color of a sewing thread to be used when the branch is embroidered and that is used by the computer to determine whether to create the embroidery data of the link destination branch specified by the link information, the instructions for creating the embroidery data including:

instructions for creating the running stitch sewing data, which is the embroidery data indicating that the running stitch sewing is to be performed between the initial point and the terminal point that are indicated by the vector data;

instructions for determining whether the color indicated by the thread color information of the link destination branch indicated by the link information of the endpoint on a sewing termination side of the running stitch sewing data is the same as a current thread color indicated by the embroidery data being created currently; and instructions for tracing from one of the endpoints on the sewing termination side of the running stitch sewing data to the link destination branch until the color indicated by the thread color information of the link destination branch is determined in the instructions for determining to be the same as the current thread color and conducting such control as to create the running stitch sewing data of the link destination branch determined to the same as the current thread color in the instructions for creating running stitch sewing data.

6. The embroidery data creation program according to claim 5, wherein the instructions for creating the embroidery data further includes:

instructions for creating the stitch sewing data, which is the embroidery data indicating that the stitch sewing is to be performed over the running stitch sewing, in accordance with the sewing method specified by the sewing method information; and instructions for creating stitch sewing data for sewing from the one of the endpoints on the sewing termination side to the other endpoint in the instructions creating stitch sewing data, when the link information of the endpoint on the sewing termination side of the running stitch sewing data created in the instructions for creating the running stitch sewing data does not indicate a link destination branch.

7. The embroidery data creation program according to claim 5, wherein the instructions for creating the embroidery data further includes:

instructions for searching for former link information, which is the link information that specifies the one of the endpoints on the sewing termination side of the stitch sewing data as the link destination; and instructions for tracing the former link information from the one of the endpoints on the sewing termination side of the stitch sewing data until the color indicated by the thread color information of the branch data having the former link information is determined in the instructions for determining to be the same as the current thread color, and conducting such control as to create the stitch sewing data for sewing the branch having the former link information determined to be of the same as the current thread color from the endpoint that indicates the former link information to the other endpoint in the instructions for creating the stitch sewing data.

8. An embroidery data creation program recorded on a non-transitory computer-readable recording medium, the program comprising:

instructions for creating embroidery data that indicate strokes of a needle of an embroidery sewing machine based on branch-structured vector data, data structure of the branch-structured vector data stored on the non-transitory computer-readable recording medium being created from line drawing information of an embroidery design and used by a computer to create the embroidery data, the data structure comprising:

at least one branch data piece, the at least one branch data piece including:

identification information that identifies a branch and that is used to specify the branch, the branch being a path of embroidery connecting two endpoints, the two endpoints including a first endpoint and a second endpoint;

sewing method information that indicates a method for sewing the branch as embroidery;

vector data that indicates a direction of the branch by positions of the first endpoint as an initial point and the second endpoint as a terminal point, and specifies a sewing position when creating running stitch sewing data and stitch sewing data, the running stitch sewing data being the embroidery data indicating running stitch sewing to be performed, and stitch sewing data being the embroidery data indicating stitch sewing to be performed over a path of the running stitch sewing in accordance with the sewing method indicated by the sewing method information;

link information that is information about a link destination branch, and specifies the branch for which the embroidery data is to be created next, the link destination branch being a second branch linking to one of the endpoints; and loop information that indicates whether tracing the link destination branch of the one of the endpoints results in generation of a loop that returns to the one of the endpoints, and that is used by the computer to determine whether to create the running stitch data of the link destination branch specified by the link information, instructions for creating embroidery data including:

instructions for creating the running stitch sewing data, which is the embroidery data that indicates that the running stitch sewing is to be performed between the initial point and the terminal points that are indicated by the vector data;

instructions for creating the stitch sewing data, which is the embroidery data that indicates the stitch sewing to be performed over the running stitch sewing, in accordance with the sewing method specified by the sewing method information; and instructions for conducting such control so as to avoid creation of the running stitch sewing data of the link destination branch of the endpoint on the sewing termination side of the running stitch sewing data in the instructions for creating running stitch sewing data and create the stitch sewing data from the endpoint on the sewing termination side to the other endpoint of the running stitch sewing data in the instructions for creating a stitch sewing data when the loop information of the endpoint on a sewing termination side of the running stitch sewing data or the stitch sewing data indicates generation of the loop.

* * * * *